US007457568B2

(12) United States Patent
Kitazawa et al.

(10) Patent No.: US 7,457,568 B2
(45) Date of Patent: Nov. 25, 2008

(54) IMAGE FORMING APPARATUS AND METHOD USING LIQUID DEVELOPMENT IN WHICH TONER DENSITY IS DETERMINED BASED ON PATCH IMAGE DENSITY

(75) Inventors: Atsunori Kitazawa, Nagano-ken (JP); Yoshiro Koga, Nagano-ken (JP); Toru Fujita, Nagano-ken (JP); Masahide Nakamura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 1 day.

(21) Appl. No.: 11/402,978

(22) Filed: Apr. 13, 2006

(65) Prior Publication Data

US 2006/0188279 A1 Aug. 24, 2006

Related U.S. Application Data

(63) Continuation of application No. 10/662,963, filed on Sep. 16, 2003, now Pat. No. 7,062,202.

(30) Foreign Application Priority Data

Sep. 25, 2002 (JP) ..... 2002-279120
Sep. 25, 2002 (JP) ..... 2002-279121
Sep. 26, 2002 (JP) ..... 2002-281162

(51) Int. Cl.
*G03G 15/10* (2006.01)
*G03G 15/00* (2006.01)

(52) U.S. Cl. ..... 399/237; 399/49; 399/57; 399/60; 399/72

(58) Field of Classification Search ..... 399/237, 399/57, 58, 60, 62, 49, 72
See application file for complete search history.

(56) References Cited

U.S. PATENT DOCUMENTS 4,847,657 A * 7/1989 Hanada et al.
4,879,577 A 11/1989 Mabrouk et al.
4,999,673 A * 3/1991 Bares ..... 399/49
5,162,874 A 11/1992 Butler
5,258,810 A * 11/1993 Bresina et al. ..... 399/72
5,706,095 A 1/1998 Rathbun
5,974,276 A * 10/1999 Oogi ..... 399/49
5,981,133 A * 11/1999 Miyamoto et al.
6,603,934 B2 * 8/2003 Shimmura ..... 399/49

(Continued)

FOREIGN PATENT DOCUMENTS

JP 1307770 A 12/1989

(Continued)

*Primary Examiner*—Susan S. Lee
(74) *Attorney, Agent, or Firm*—Sughrue Mion, PLLC

(57) ABSTRACT

A CPU 113 executes a control program stored in a memory 116 thereby forming a plurality of patch images with a developing bias increased for each of the patch images; detecting a density of each of the patch images by means of a patch sensor 17; and comparing the image densities to determine whether the image density is saturated or not. Then, an image forming condition in which an image density is substantially saturated is determined and is stored in the memory 116. When a print command signal is inputted from an external device via a main controller 100, a printing operation is performed under the image forming condition stored in the memory 116.

19 Claims, 19 Drawing Sheets

U.S. PATENT DOCUMENTS

| | | | | |
|---|---|---|---|---|
| 6,650,849 | B2 | 11/2003 | Shimura | |
| 6,738,586 | B2 | 5/2004 | Kubota et al. | |
| 6,853,817 | B2 * | 2/2005 | Suzuki | 399/49 |

FOREIGN PATENT DOCUMENTS

| | | | | |
|---|---|---|---|---|
| JP | 07-209922 | A | | 8/1995 |
| JP | 08292622 | A | | 5/1996 |
| JP | 08-227218 | | | 9/1996 |
| JP | 08-289148 | A | | 11/1996 |
| JP | 08289148 | A | * | 11/1996 |
| JP | 08292622 | A | | 11/1996 |
| JP | 09-114257 | A | | 5/1997 |
| JP | 09134044 | A | | 5/1997 |
| JP | 09222780 | A | | 8/1997 |

* cited by examiner

IMAGE FORMING APPARATUS AND METHOD USING LIQUID DEVELOPMENT IN WHICH TONER DENSITY IS DETERMINED BASED ON PATCH IMAGE DENSITY

This is a continuation of application Ser. No. 10/662,963 filed Sep. 16, 2003 now U.S. Pat. No. 7,062,202. The entire disclosure of the prior application, application Ser. No. 10/662,963 is hereby incorporated by reference.

BACKGROUND OF THE INVENTION

1. Field of the Invention

The present invention relates to an electrophotographic image forming technique such as for printers, copiers, facsimile machines and the like. More particularly, the invention relates to an electrophotographic image forming technique adopting liquid development.

2. Description of the Related Art

Conventionally, the electrophotographic image forming apparatuses have been put to actual use, which are adapted to provide a predetermined image by taking the steps of: exposing a charged photosensitive member (image carrier) by means of exposure means thereby forming an electrostatic latent image on the photosensitive member; causing toner to adhere to the photosensitive member by means of developing means thereby developing the electrostatic latent image into a toner image; and transferring the toner image onto a transfer sheet. There have been known liquid development and powder development as a development system taken by the developing means. Liquid development has several advantages, which include: providing an image of higher resolution by virtue of the use of toner having a mean particle size of 0.1 to 2 μm, which is smaller than that of toner used in powder development; providing an image of a consistent quality because of the toner being provided as liquid developer having high fluidity; and the like. On this account, there have been proposed various types of image forming apparatuses using liquid development system (see, for example, Japanese Unexamined Patent Publication No. 7-209922 of 1995).

This conventional image forming apparatus includes a developing roller (liquid developer carrier) for transporting liquid developer toward a development position facing the photosensitive member while carrying the liquid developer on its surface, the liquid developer with charged toner dispersed in a carrier liquid. The charged toner in the liquid developer filling a gap (development gap) between the photosensitive member and the developing roller is transferred to the photosensitive member, thereby developing the electrostatic latent image on the photosensitive member into a toner image.

The image forming apparatus of liquid development system using liquid developer so arranged involves a problem that when an electric field applied to the charged toner at the development position varies or the toner density in the liquid developer varies, the density of the toner image formed by developing the electrostatic latent image varies. The electric field is affected by the variations of image forming conditions including a developing bias, exposure energy, charging bias and the like, and by the variations of a dimension of the development gap. Thus, the variations of the image forming conditions, the variations of the dimension of the development gap and the variations of the toner density in the liquid developer affect the density of the toner image, thus constituting causative factors of a degraded image quality of the toner image as exemplified by insufficient image density, image density variations and the like. In order to attain the image of a consistent quality, therefore, need exists for providing measure to prevent the density of the toner image from being affected by the variations of the image forming conditions or of the dimension of the development gap, or for controlling the toner density in the liquid developer with high accuracy.

SUMMARY OF THE INVENTION

A principal object of the present invention is to provide an image forming apparatus and method of liquid development which ensure that the density of the toner image is not affected by the variations of the image forming conditions or of the dimension of the development gap in the formation of a normal toner image.

Another object of the present invention is to provide an image forming apparatus and method of liquid development which are adapted to determine an accurate toner density in the liquid developer.

According to a first aspect of the present invention, there is provided an image forming apparatus comprising: an image carrier structured to carry an electrostatic latent image on its surface; a liquid developer carrier which transports liquid developer toward a development position facing the image carrier while carrying the liquid developer on its surface, the liquid developer with charged toner dispersed in a carrier liquid; and image forming means which applies a predetermined developing bias to the liquid developer carrier for causing the toner in the liquid developer carried on the liquid developer carrier to adhere to the image carrier, thereby developing the electrostatic latent image with the toner into a toner image, wherein the image forming means forms a normal toner image under an image forming condition in which an adhesion amount of toner to the image carrier is substantially saturated relative to an increase of contrast potential.

According to a second aspect of the present invention, there is provided an image forming apparatus comprising: an image carrier structured to carry an electrostatic latent image on its surface; a liquid developer carrier which transports liquid developer toward a development position facing the image carrier while carrying the liquid developer on its surface, the liquid developer with charged toner dispersed in a carrier liquid; and image forming means which applies a predetermined developing bias to the liquid developer carrier for causing the toner in the liquid developer on the liquid developer carrier to adhere to the image carrier, thereby developing the electrostatic latent image with the toner into a toner image; and density detection means for detecting a density of the toner image formed as a patch image by the image forming means, wherein the image forming means forms the patch image under an image forming condition in which an adhesion amount of toner to the image carrier is substantially saturated relative to an increase of contrast potential, and wherein a toner density in the liquid developer is determined based on the density of the patch image detected by the density detection means.

According to a third aspect of the present invention, there is provided an image forming apparatus comprising: an image carrier structured to carry an electrostatic latent image on its surface; a liquid developer carrier which transports liquid developer toward a development position facing the image carrier while carrying the liquid developer on its surface, the liquid developer with charged toner dispersed in a carrier liquid; image forming means which applies a predetermined developing bias to the liquid developer carrier for causing the toner in the liquid developer on the liquid developer carrier to adhere to the image carrier, thereby developing the electrostatic latent image with the toner into a toner image; and density detection means for detecting a density of a toner image formed as a patch image by the image forming means, wherein the image forming means forms the patch image under an image forming condition in which not less than 90% of the toner in the liquid developer at the development position is adhered to the image carrier and wherein a toner density in the liquid developer is determined based on the density of the patch image detected by the density detection means.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENTS

First Preferred Embodiment

Figure 1:
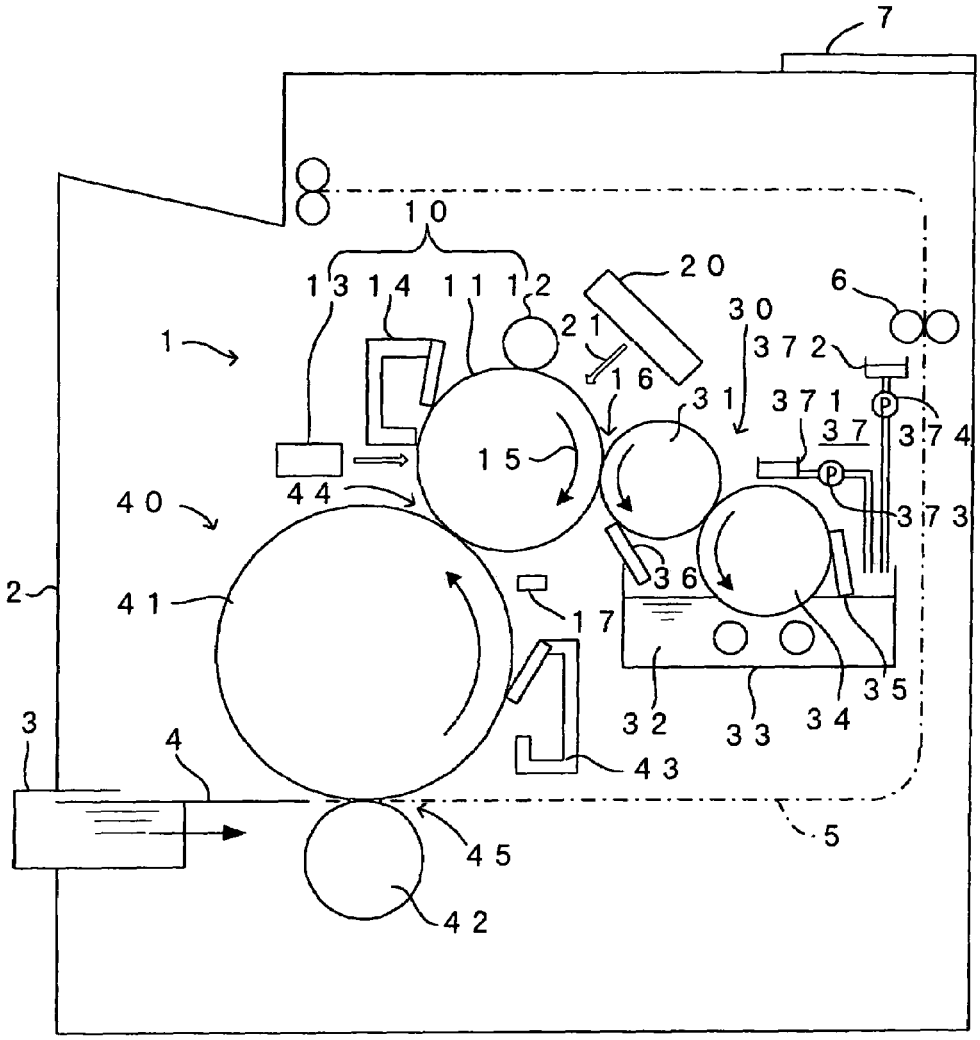
FIG. 1 is a drawing showing an internal structure of a printer which is a first preferred embodiment of an image forming apparatus of the present invention.
Figure 2:
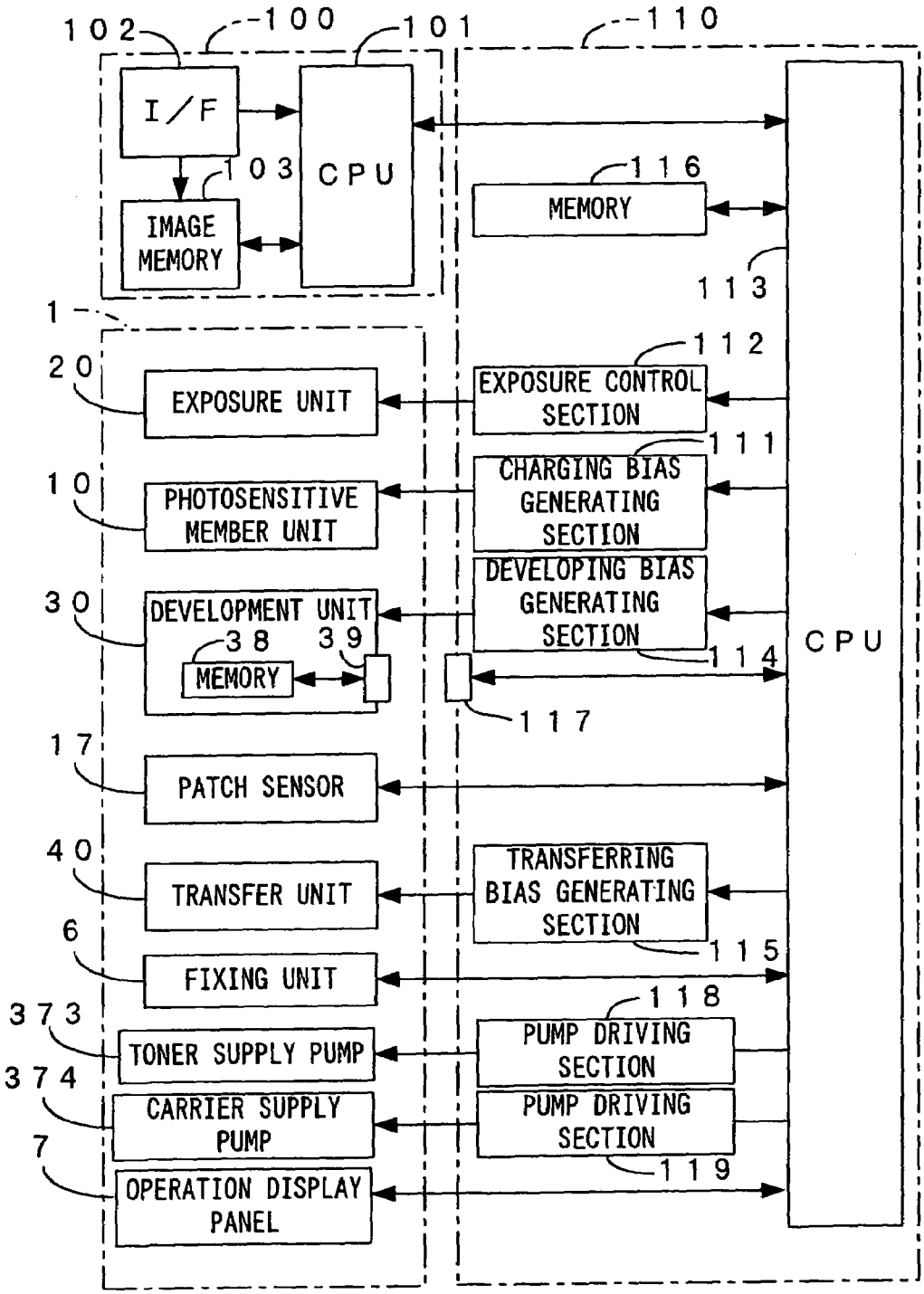
FIG. 2 is a block diagram showing an electric structure of the printer.

FIG. 1 is a drawing showing an internal structure of a printer which is a first preferred embodiment of an image forming apparatus of the present invention, FIG. 2 is a block diagram showing an electric structure of the printer. This printer is an image forming apparatus of liquid development system, which is designed to form a monochromatic image using liquid developer containing a black (K) toner. When a print command signal including an image signal is supplied to a main controller 100 from an external device such as a host computer, an engine controller 110 responds to a control signal from the main controller 100 so as to control individual parts of an engine section 1 for printing an image corresponding to the image signal on a transfer sheet, copy sheet or sheet (hereinafter, referred to as "transfer sheet") delivered from a sheet cassette 3 disposed at a lower part of an apparatus body 2.

The engine section 1 includes a photosensitive member unit 10, an exposure unit 20, a development unit 30, a transfer unit 40 and the like. Of these units, the photosensitive member unit 10 includes a photosensitive member 11, a charger 12, a static eliminator 13 and a cleaner 14. The development unit 30 includes a developing roller 31 and the like. The transfer unit 40 includes an intermediate transfer roller 41 and the like.

The photosensitive member unit 10 is provided with the photosensitive member 11 which is rotatable in a direction of an arrow 15 in FIG. 1 (clockwise direction as seen in the figure). Disposed around the photosensitive member 11 are the charger 12, developing roller 31, intermediate transfer roller 41, static eliminator 13 and cleaner 14 along the rotating direction 15. A surface portion of the photosensitive member defined between the charger 12 and the developing roller 31 serves as an exposure region exposed to a light beam 21 from the exposure unit 20. The charger 12 according to the embodiment comprises a charging roller, which is applied with a charging bias from a charging bias generating section 111 so as to uniformly charge an outer peripheral surface of the photosensitive member 11 to a predetermined surface potential Vd (e.g., Vd=DC+600V). Thus, the charger functions as charging means.

The exposure unit 20 irradiates the light beam 21, such as of a laser, on the outer peripheral surface of the photosensitive member 11 thus uniformly charged by the charger 12. In response to a control command sent from an exposure control section 112, the exposure unit 20 exposes the photosensitive member 11 with the light beam 21 thereby forming an electrostatic latent image thereon in correspondence to the image signal. Thus, the exposure unit 20 functions as exposure means. When the external device such as a host computer supplies the print command signal including the image signal to a CPU 101 of the main controller 100 via an interface 102, a CPU 113 responds to a command from the CPU 101 of the main controller 100, thus outputting a control signal to the exposure control section 112 in a predetermined timing, the control command corresponding to the image signal. Based on the control signal from the exposure control section 112, the exposure unit 20 exposes the photosensitive member 11 with the light beam 21 so as to form thereon an electrostatic latent image in correspondence to the image signal. When, as occasion demands, a patch image to be described later is formed, a control signal corresponding to a patch image signal of a predetermined pattern (such as a solid image, fine line image or hollow fine-line image) is fed from the CPU 113 to the exposure control section 112, such that an electrostatic latent image corresponding to the above-described pattern is formed on the photosensitive member 11. According to th is embodiment, the photosensitive member 11 is equivalent to "an image carrier" of the present invention.

The resultant electrostatic latent image is developed with toner supplied from the developing roller 31 of the development unit 30. In addition to the developing roller 31, the development unit 30 includes: a reservoir 33 storing liquid developer 32 therein; an application roller 34 for applying the liquid developer 32 to the developing roller 31 by drawing up the liquid developer 32 stored in the reservoir 33; a regulating blade 35 for limiting liquid developer layer on the application roller 34 to a constant thickness; a cleaning blade 36 for removing the liquid developer remaining on the developing roller 31 after toner supply to the photosensitive member 11; a toner density adjusting section 37; and a memory 38 (FIG. 2) which is described later. The developing roller 31 is rotated in a direction driven by the photosensitive member 11 (counter-clockwise direction as seen in FIG. 1) at the same circumferential speed as the photosensitive member 11. The application roller 34 is rotated in the same direction as the developing roller 31 (counter-clockwise direction as seen in FIG. 1) at about twice the circumferential speed of the developing roller 31.

According to the embodiment, the liquid developer 32 comprises toner dispersed in a carrier liquid, the toner comprising a coloring pigment; an adhesive such as an epoxy resin for bonding the coloring pigments; a charge control agent for charging the toner to a predetermined electric charge; and a dispersant for homogeneously dispersing the coloring pigments. According to this embodiment, a silicone oil such as polydimethylsiloxane oil is used as the carrier liquid. A toner density is adjusted to the range from 5 to 40 wt %, which is higher than that of a low-density liquid developer (a toner density from 1 to 2 wt %) widely used in the liquid development system. The type of the carrier liquid is not limited to the silicone oil. A viscosity of the liquid developer 32 depends on the type of the carrier liquid used, the ingredients of the toner, the toner density and the like. According to this embodiment, the liquid developer 32 has a viscosity of 50 to 6000 mPa·s, for example, which is higher than that of the low-density liquid developer.

The toner density adjusting section 37 includes a supply tank 371 storing therein liquid developer having a further higher toner density than the liquid developer in the reservoir 33, and a supply tank 372 storing therein the aforesaid carrier liquid. When a toner supply pump 373 is operated, the high-density liquid developer is supplied from the supply tank 371 to the reservoir 33 so that the toner density in the liquid developer 32 in the reservoir 33 is increased. When, on the other hand, a carrier supply pump 374 is operated, the carrier liquid is supplied from the supply tank 372 to the reservoir 33 so that the toner density in the liquid developer 32 in the reservoir 33 is decreased. The pumps 373, 374 are driven by pump driving sections 118, 119 respectively. Thus the toner density in the liquid developer 32 in the reservoir 33 is adjusted by way of control of the operations of the pumps 373, 374.

The development unit 30 of this structure described above operates as follows. The liquid developer 32 stored in the reservoir 33 is drawn up by the application roller 34, while the layer of the liquid developer on the application roller 34 is limited to a constant thickness by means of the regulating blade 35. The liquid developer 32 in such a consistent layer is allowed to adhere to a surface of the developing roller 31 so as to be transported toward a development position 16 facing the photosensitive member 11 in conjunction with the rotation of the developing roller 31. The toner is, for example, positively charged by the effect of the charge control agent and the like. At the development position 16, the toner is transferred from the developing roller 31 to the photosensitive member 11 by means of a developing bias Vb applied to the developing roller 31 by a developing bias generating section 114 and thus, the electrostatic latent image is developed. The developing bias Vb is determined by an optimization process to be described later and is approximately at a level of, for example, Vb=DC+400V. According to this embodiment, the developing roller 31 is equivalent to "a liquid developer carrier", the developing bias generating section 114 is equivalent to "an image forming means" of the present invention.

The toner image thus formed on the photosensitive member 11 is transported by the rotating photosensitive member 11 to a primary transfer position 44 facing the intermediate transfer roller 41. The intermediate transfer roller 41 is rotated in the direction driven by the photosensitive member 11 (counter-clockwise direction as seen in FIG. 1) at the same circumferential speed as the photosensitive member 11. When a primary transferring bias (e.g., DC-400V) from a transferring bias generating section 115 is applied to the intermediate transfer roller, the toner image on the photosensitive member 11 is primarily transferred to the intermediate transfer roller 41. After the primary image transfer, a residual potential at the photosensitive member 11 is eliminated by the static eliminator 13 such as formed of an LED, whereas a residual liquid developer is removed by the cleaner 14.

A secondary transfer roller 42 is disposed at a proper place with respect to the intermediate transfer roller 41 (vertically downward place thereof as illustrated in FIG. 1) in face-to-face relation therewith. The primary transfer toner image thus transferred to the intermediate transfer roller 41 is conveyed on the rotating intermediate transfer Toiler 41 to a secondary transfer position 45 facing the secondary transfer roller 42. On the other hand, a transfer sheet 4 stored in the sheet cassette 3 is transported to the secondary transfer position 45 by means of a transportation driving section (not shown) operative in synchronization with the transportation of the primary transfer toner image. The secondary transfer roller 42 is rotated in a direction driven by the intermediate transfer roller 41 (clockwise direction as seen in FIG. 1) at the same circumferential speed as the intermediate transfer roller 41. At application of a secondary transferring bias (e.g., −100 μA under constant current control) from the transferring bias generating section 115, the toner image on the intermediate transfer roller 41 is secondarily transferred to the transfer sheet 4. After the secondary image transfer, the liquid developer remaining on the intermediate transfer roller 41 is removed by a cleaner 43. The transfer sheet 4 with the toner image secondarily transferred thereto is transported along a predetermined transfer-sheet transport path 5 (indicated by an alternate long and short dash line in FIG. 1). The toner image is fixed to the transfer sheet 4 by a fixing unit 6 and then, the transfer sheet 4 is discharged onto a discharge tray disposed at an upper part of the apparatus body 2.

On the other hand, a patch sensor 17, such as of a reflex optical sensor, is disposed at a place around the photosensitive member 11 and between the developing roller 31 and the intermediate transfer roller 41 in a manner to confront the photosensitive member 11. The patch sensor 17 operates to detect a density of the patch image formed on the photosensitive member 11, as will be described later. Disposed on a top surface of the apparatus body 2 is a n operation display panel 7 comprising, for example, a liquid-crystal display and a touch panel. The operation display panel 7 accepts a control command given by a user while displaying predetermined information to inform the user. According to the embodiment, the patch sensor 17 is equivalent to a "density detection means" of the present invention.

Referring to FIG. 2, the main controller 100 includes an image memory 103 for storing the image signal supplied from the external device via the interface 102. Receiving the print command signal including the image signal from the external device via the interface 102, the CPU 101 converts the signal into job data of a format adapted for operation instruction supplied to the engine section 1 before outputting the resultant data to the engine controller 110. A memory 116 of the engine controller 110 comprises a ROM for storing a control program of the CPU 113, the program including previously defined fixed data, and a RAM for temporarily storing control data for the engine section 1, operation results given by the CPU 113, and the like. The CPU 113 stores data on the image signal in the memory 116, the image signal sent from the external device via the CPU 101.

A memory 38 of the development unit 30 is for storage of data on a production lot and use history of the development unit 30, characteristics of toner contained therein, an amount of remaining liquid developer 32, a toner density and the like. The memory 38 is electrically connected with a communication portion 39 which is mounted to, for example, the reservoir 33. An arrangement is made such that mounting the development unit 30 in the apparatus body 2 brings the communication portion 39 into facing relation with a communication portion 117 of the engine controller 110, these communication portions spaced from each other by a predetermined distance, say 10 mm, or less. These communication portions 39, 117 are adapted to transmit/receive data in a non-contact fashion based on radio communication using infrared rays for example. The arrangement permits the CPU 113 to manage a variety of information items, such as consumable article management, concerning the development unit 30. While the embodiment employs electromagnetic means, such as radio communication, for performing the non-contact data transmission/reception, an alternative arrangement may be made wherein, for example, the apparatus body 2 and the development unit 30 are provided with a connector, respectively, such that mounting the development unit 30 in the apparatus body 2 establishes mechanical engagement between these connectors which permit the data to be transmitted/received between the apparatus body 2 and the development unit 30. The memory 38 may preferably be a non-volatile memory capable of retaining the data in a power-OFF state or when the development unit 30 is dismounted from the apparatus body 2. Examples of a preferred non-volatile memory include EEPROMs such as flash memories, high dielectric memories and the like.

Figure 3:
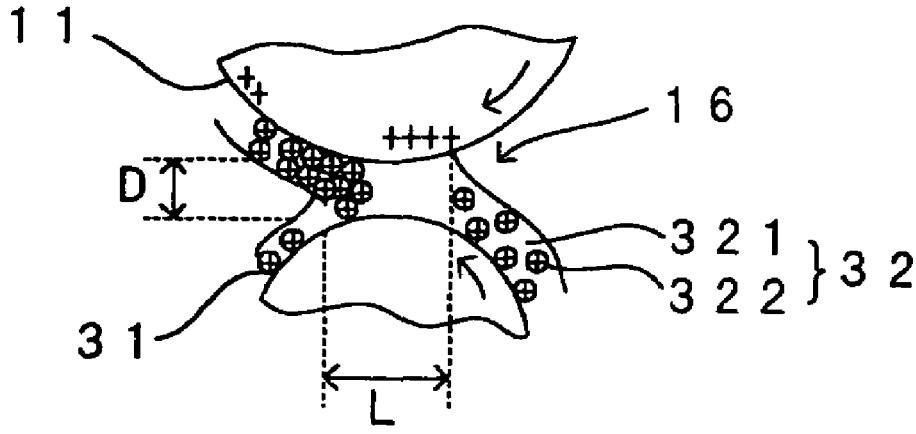
FIG. 3 is an enlarged view showing a development nip.
Figure 4A:
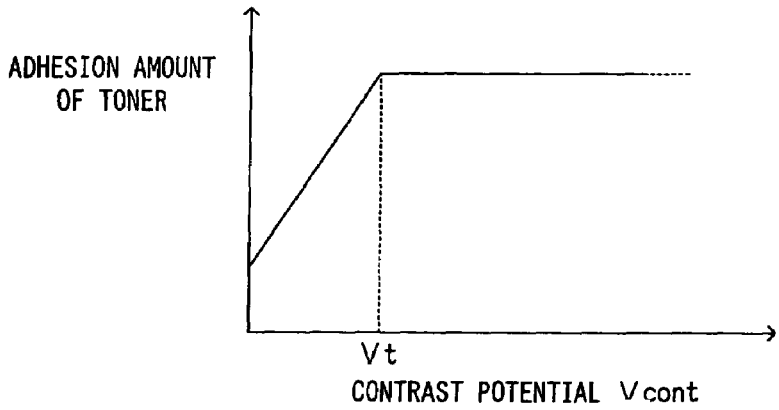
FIGS. 4A and 4B are graphs each illustrating the variations of the adhesion amount of toner relative to a contrast potential.
Figure 4B:
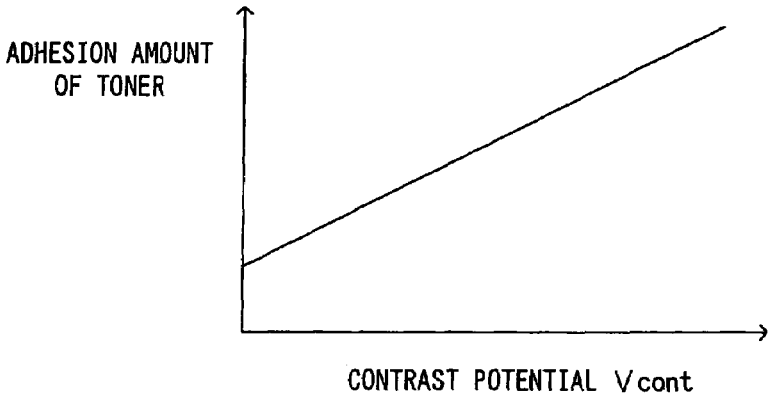

FIG. 3 is an enlarged view showing a development nip portion, whereas FIGS. 4A and 4B are graphs each illustrating the variations of the adhesion amount of toner to the photo sensitive member relative to a contrast potential. As shown in FIG. 3, a distance D between the photosensitive member 11 and the developing roller 31 is so regulated as to maintain a consistent development gap in a predetermined range of from 5 to 40 μm based on the thickness of liquid developer layer (e.g., D=7 μm according to the embodiment). On the other hand, a length L of the development nip according to the embodiment is defined as, for example, L=5 mm based on a circumferential length on which liquid developer layer is in contact with both the photosensitive member 11 and the developing roller 31.

The liquid developer 32 with toner 322 dispersed in a carrier liquid 321 is transported toward the development position 16 while being carried on the developing roller 31. On the other hand, the photosensitive member 11 is uniformly charged to a potential Vd by means of the charger 12 so that the toner 322 is made to adhere to an area thereof where the charge is neutralized by irradiation with the light beam 21 from the exposure unit 20.

In the above case where the low-density liquid developer is used, a large development gap of from 100 to 200 μm must be provided to ensure a required amount of toner. In contrast, the embodiment employing the high-density liquid developer can reduce the development gap D. Therefore, the toner may be electrophoretically moved in the liquid developer for a reduced distance. Besides, a higher electric field is produced by applying the same level of developing bias. This leads to an increased development efficiency and hence, a high-speed development process may be accomplished.

Furthermore, the development gap D is defined to be so small that when the contrast potential Vcont is increased by increasing the developing bias Vb, for example, the resultant electric field exhibits a sharp increase accordingly. As shown in FIG. 4A, therefore, the amount of toner transferred from the developing roller 31 to adhere to the photosensitive member 11 is increased sharply but becomes substantially saturated at a given potential or above (Vcont=Vt as shown in the figure).

When the contrast potential Vcont is in the range of Vt or above as shown in FIG. 4A, the adhesion amount of toner is saturated and hence, the density of the toner image formed at the contrast potential in this range is varied little regardless of some degrees of variations of image forming conditions including the developing bias, charging bias, exposure energy and the like, or of the dimension of the development gap. That is, this prevents the density of the toner image from being affected by the variations of the image forming conditions or of the dimension of the development gap. On this account, the printer is adapted to form the toner image under the image forming conditions included in this range. Thus is obviated the degradation of the image quality associated with insufficient density or density variations.

It is noted here that "the adhesion amount of toner being substantially saturated" means that the increase of the contrast potential Vcont causes little increase in the amount of toner contributing to the development of the electrostatic latent image. The adhesion amount of toner being saturated naturally includes a case where all the toner present in the liquid developer on the developing roller 31 is made to adhere to the photosensitive member 11, but also a case where the amount of toner made to adhere to the photosensitive member 11 is limited to a given percentage (e.g., 90% or 95%) based on the liquid developer carried on the developing roller 31 due to the characteristics of a device (such as the photosensitive member unit 10 or the development unit 30), but is not increased any further no matter how the contrast potential Vcont is increased.

Where the low-density liquid developer (such as containing 1 to 2 wt % of toner) is used, on the other hand, the large development gap D (e.g., D is in the range from 100 to 200 μm) must be provided to ensure the required amount of toner. Accordingly, increasing the contrast potential Vcont only provides a slow increase in the magnitude of the resultant electric field. Thus, as shown in FIG. 4B which shows a reference example, the amount of toner transferred from the developing roller 31 to adhere to the photosensitive member 11 continues to rise slowly but is not saturated.

Figure 5:
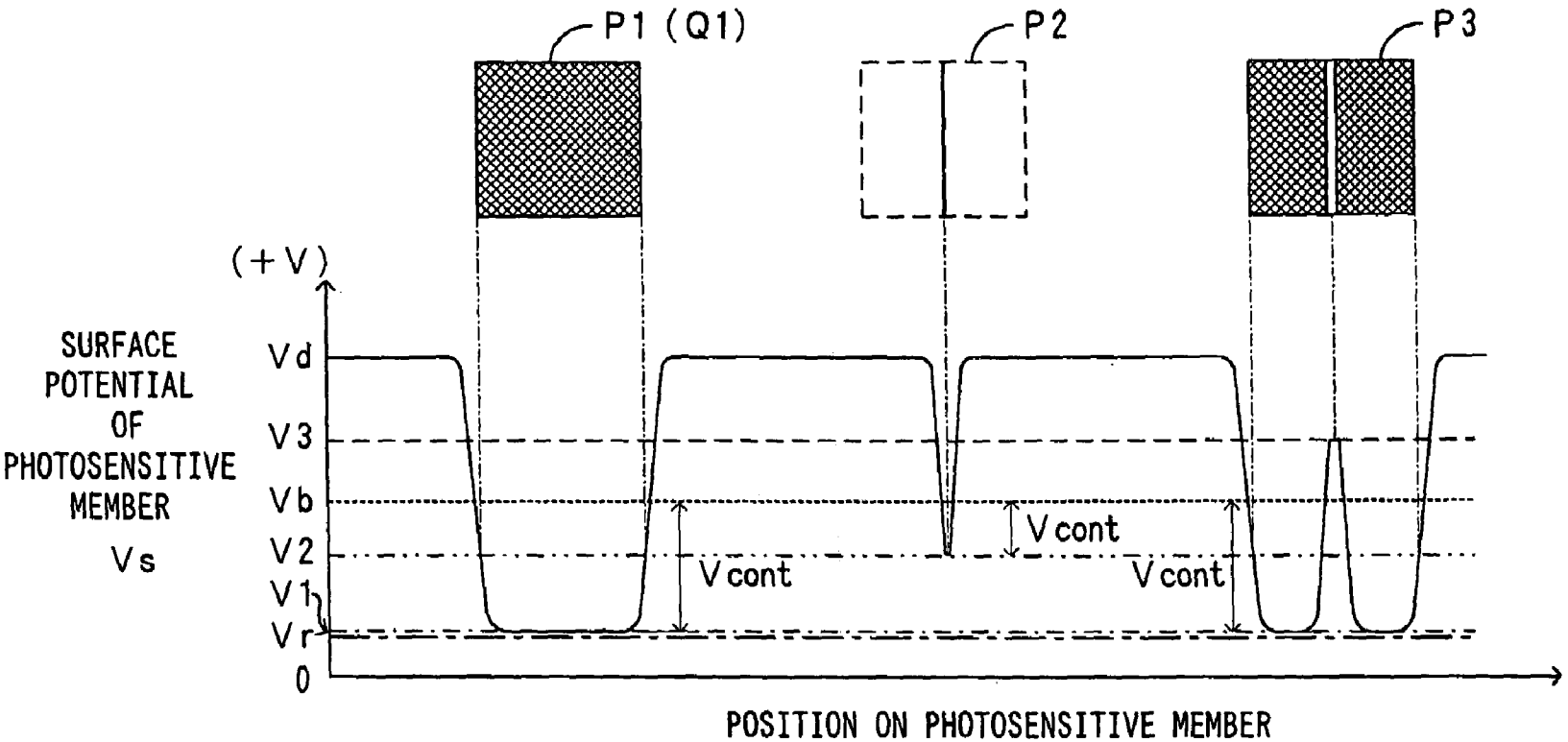
FIG. 5 is a graph illustrating surface potential profiles of a photosensitive member.
Figure 6:
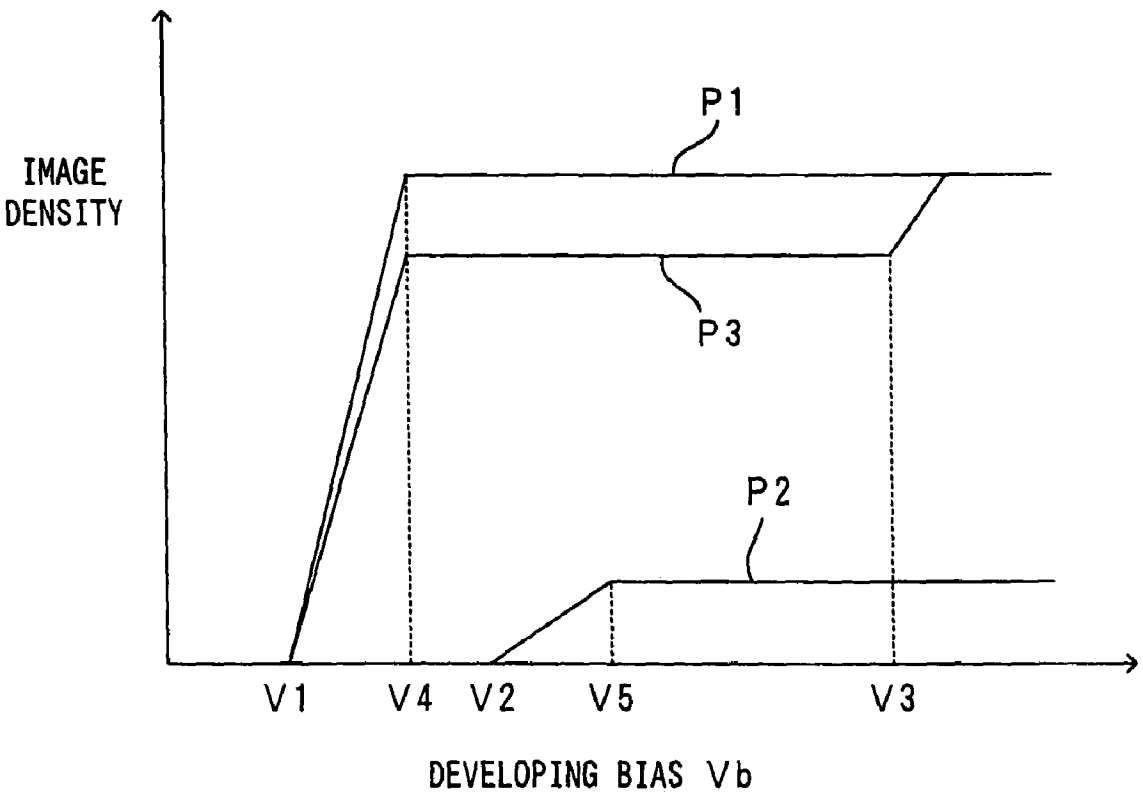
FIG. 6 is a graph schematically illustrating the variations of image density relative to the variations of developing bias.

FIG. 5 is a graph illustrating surface potential profiles of the photosensitive member 11 formed with a solid image P1, a low-density image P2 and an intermediate-density image P3, whereas FIG. 6 is a graph schematically illustrating the variations of image density of each of the images P1 to P3 relative to the variations of developing bias. It is noted that the images of FIG. 6 are formed with the image forming conditions fixed (the charging bias, exposure energy and the like) except for the developing bias Vb.

When the photosensitive member 11 uniformly charged to a potential Vd (e.g., Vd=DC+600V according to the embodiment) by means of the charger 12 is partially exposed to the light beam 21, the potential at the exposed area is saturated so that the electrostatic latent image is formed on the surface of the photosensitive member 11. A relatively larger area of the surface of the photosensitive member 11 is exposed to the light in the formation of the solid image P1 and hence, a surface potential profile therefor assumes a well shape wherein the surface potential is lowered to a potential V1 substantially equal to a residual potential Vr dependent upon the characteristics of the photosensitive member 11. In contrast, a relatively smaller area is exposed to the light in the formation of the low-density image P2 (such as a fine-line image according to the embodiment) and hence, a surface potential profile therefor assumes a dip shape wherein a surface potential Vs is sharply dropped but only to a potential V2 (>V1). On the other hand, a narrow non-exposure area is sandwiched between exposed areas in the formation of the intermediate-density image P3 (such as a hollow line image according to the embodiment) and hence, a surface potential Vs at an area corresponding to a hollow portion is restored only to a potential V3 but not to as high as Vd. While FIG. 5 illustrates the images P2, P3 each consisting of a single line, the same holds for an image consisting of a plurality of lines arranged in spaced relation.

When the electrostatic latent image having such a surface potential profile is delivered to the development position 16 facing the developing roller 31 (FIG. 3), the toner 322 in the liquid developer 32 at the developing position 16 is made to adhere to either the developing roller 31 or the photosensitive member 11 depending upon the magnitude of the DC potential at respective pairs of corresponding portions of the developing roller 31 and the photosensitive member 11. In this process, the greater the difference between the developing bias Vb and the surface potential Vs of the photosensitive member 11 or the greater the contrast potential Vcont, the more promoted is the toner transfer from the developing roller 31 to the photosensitive member 11. Thus, the greater the potential difference or the contrast potential Vcont, the greater the amount of toner adhered to the photosensitive member 11. Accordingly, with the increase in the contrast potential, the image density is also increased and then become saturated at a certain potential, as described above.

First, the formation of the solid image P1 is described. As shown in FIG. 6, when the developing bias Vb increased from 0 reaches Vb>V1, the contrast potential Vcont takes a positive value so that the image density starts to increase. After the point of time that a sufficient contrast potential Vcont is attained (Vb=V4>V1 in FIG. 6), the image density stays at a constant level despite the increase in the developing bias Vb, thus substantially entering saturation.

Next, the formation of the low-density image P2 is described When the developing bias Vb increased from 0 reaches Vb>V2, the contrast potential Vcont takes a positive value so that the image density starts to increase. After the point of time that a sufficient contrast potential Vcont is attained (Vb=V5>V2 in FIG. 6), the image density stays at a constant level despite the increase in the developing bias Vb, thus substantially entering saturation.

Next, the formation of the intermediate-density image P3 is described. When the developing bias Vb increased from 0 reaches Vb>V2, the contrast potential Vcont takes a positive value so that the image density starts to increase. After the point of time that a sufficient contrast potential Vcont is attained (Vb=V4>V1 in FIG. 6), the image density stays at a constant level despite the increase in the developing bias Vb, thus substantially entering saturation. When the developing bias Vb is further increased to reach Vb>V3, the image density rises because the toner is adhered to the hollow portion as well. When the developing bias Vb is increased to a level well above the potential V3, the image density reaches substantially the same level as that of the solid image, thus entering saturation. While a saturation start potential for the intermediate-density image P3 coincides with that for the solid image P1 according to this embodiment, there may be a case where the saturation start potentials for these images do not coincide with each other depending upon the type of toner used or the structure of the apparatus.

The foregoing suggests the followings.

1: A favorable solid image P1 can be formed where the developing bias Vb is set in the range of V4<Vb;

2: Favorable low-density image P2 and solid image P1 can be formed where the developing bias Vb is set in the range of V5<Vb;

3: Favorable intermediate-density image P3 and solid image P1 can be formed where the developing bias Vb is set in the range of V4<Vb<V3; and 4: Favorable solid image P1, low-density image P2 and intermediate-density image P3 can be formed where the developing bias Vb is set in the range of V5<Vb<V3.

Considering these, this printer performs the optimization process at a proper time when the printer is turned on, when a predetermined number of prints have been produced, or the like. The optimization process includes the steps of: forming a group of a plurality of patch images corresponding to the solid image P1, forming a group of a plurality of patch images corresponding to the low-density image P2, and forming a group of a plurality of patch images corresponding to the intermediate-density image P3, the patch images of each group being formed in varying the contrast potential; and detecting the densities of the patch images for determining an image forming condition in which an image density is substantially saturated. An example of the patch images of each group mentioned above will be described below and thereafter, the operations of the embodiment will be described in details.

Figure 7:
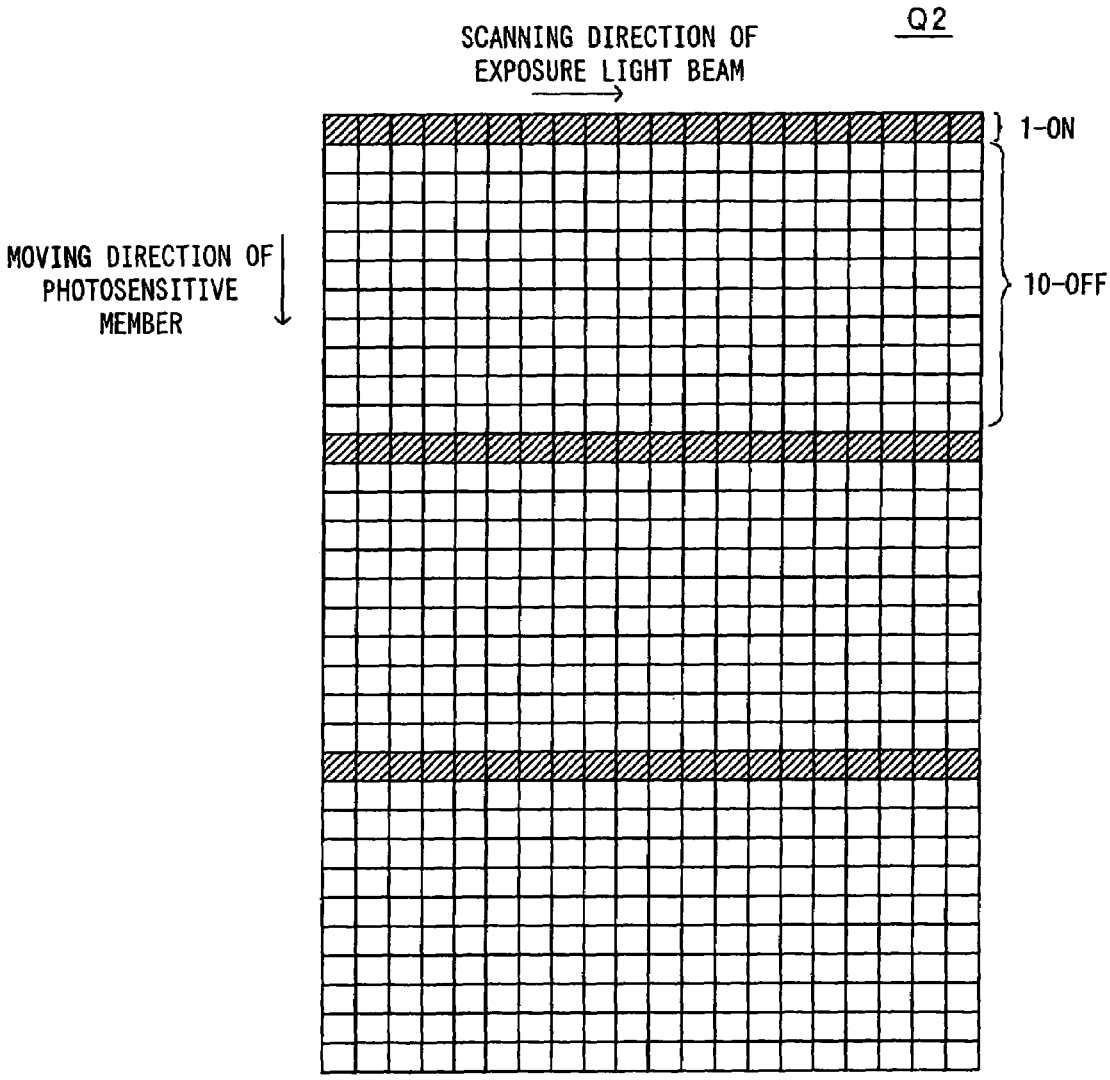
FIG. 7 is a diagram showing one example of a low-density patch image.
Figure 8:
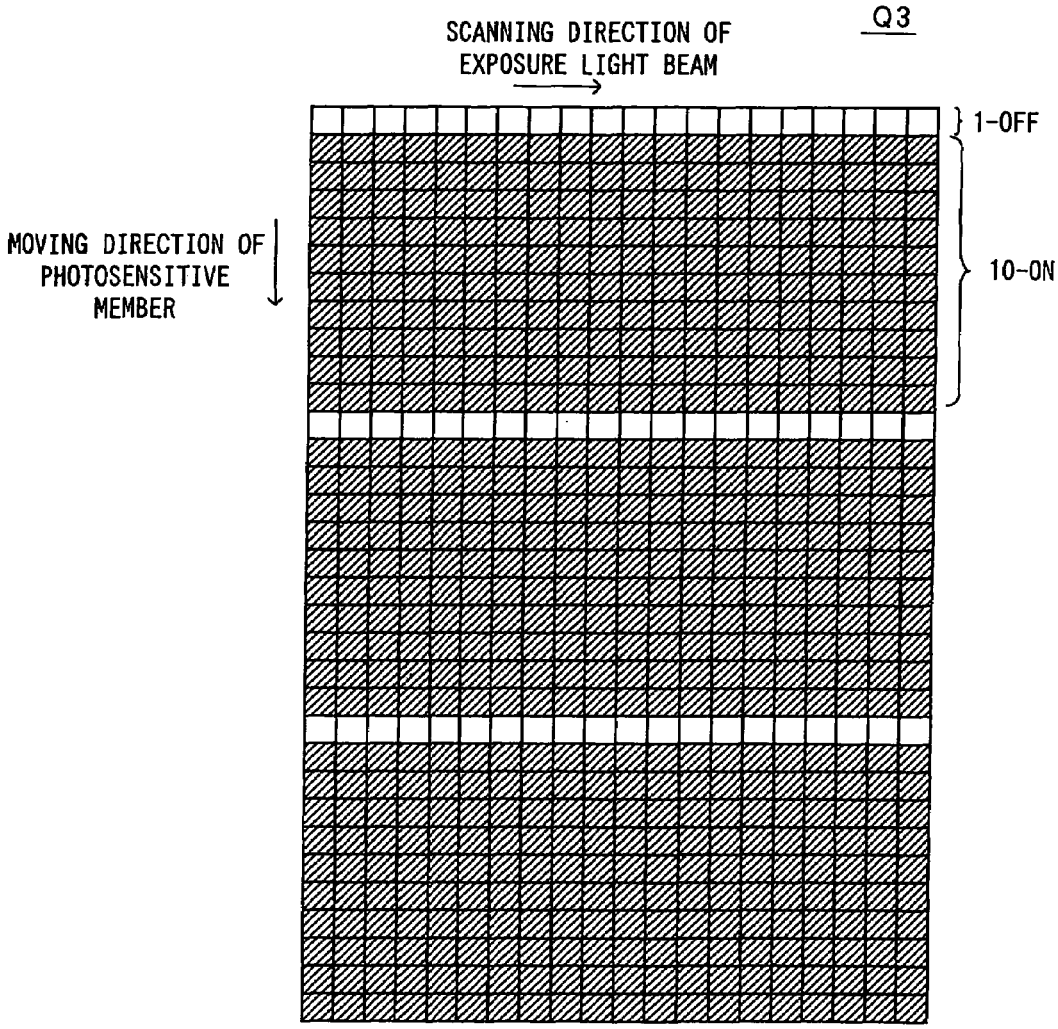
FIG. 8 is a diagram showing one example of an intermediate-density patch image.

FIG. 7 is a diagram showing one example of a low-density patch image Q2 corresponding to the low-density image P2, whereas FIG. 8 is a diagram showing one example of an intermediate-density patch image Q3 corresponding to the intermediate-density image P3. As shown in FIG. 7, the low-density patch image Q2 according to the embodiment is a fine-line image including a group of 1-dot lines based on a 1-ON/10-OFF dot-line pattern. While the dot line group may include 2 or more on-dot lines, the dot line group may preferably include 1 on-dot line in the light of obtaining the image forming conditions ensuring a reliable formation of the fine-line image. On the other hand, the number of off-dot lines is not limited to 10 but may be any number, say 3 or more, that adjoining on-dot lines are adequately spaced away from each other. Although FIG. 7 illustrates the fine-line image, an alternative patch image comprising discrete dots may be used.

As shown in FIG. 8, the intermediate-density patch image Q3 according to the embodiment is a hollow line image including a group of 1-dot lines based on a 10-ON/1-OFF dot-line pattern. While the dot line group may include 2 or more off-dot lines, the dot line group may preferably include 1 off-dot line in the light of obtaining the image forming condition ensuring a reliable formation of the hollow line image. On the other hand, the number of on-dot lines is not limited to 10 but may be any number, say 3 or more, that adjoining off-dot lines are adequately spaced away from each other. Although FIG. 8 illustrates the hollow line image, an alternative patch image comprising discrete hollow dots may be used.

A similar solid image to the solid image P1 shown in FIG. 5, for example, may be used as the solid patch image Q1 corresponding to the solid image P1.

Figure 9:
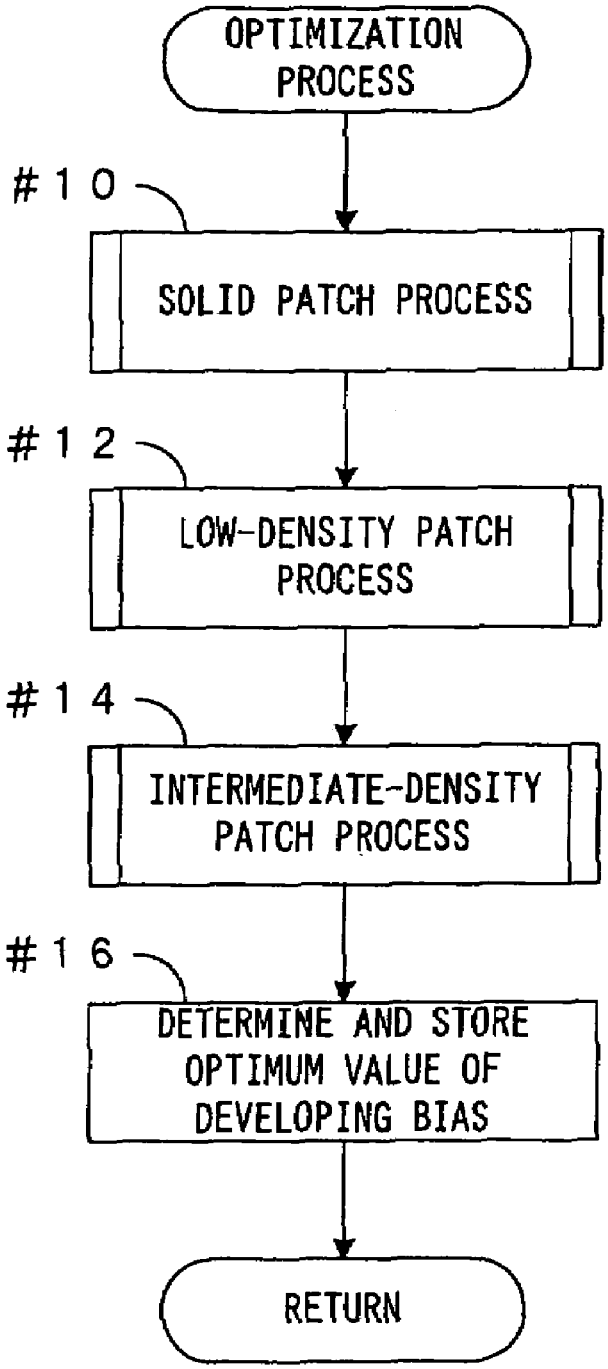
FIG. 9 is a flow chart representing the steps of an optimization process routine for image forming condition.
Figure 10:
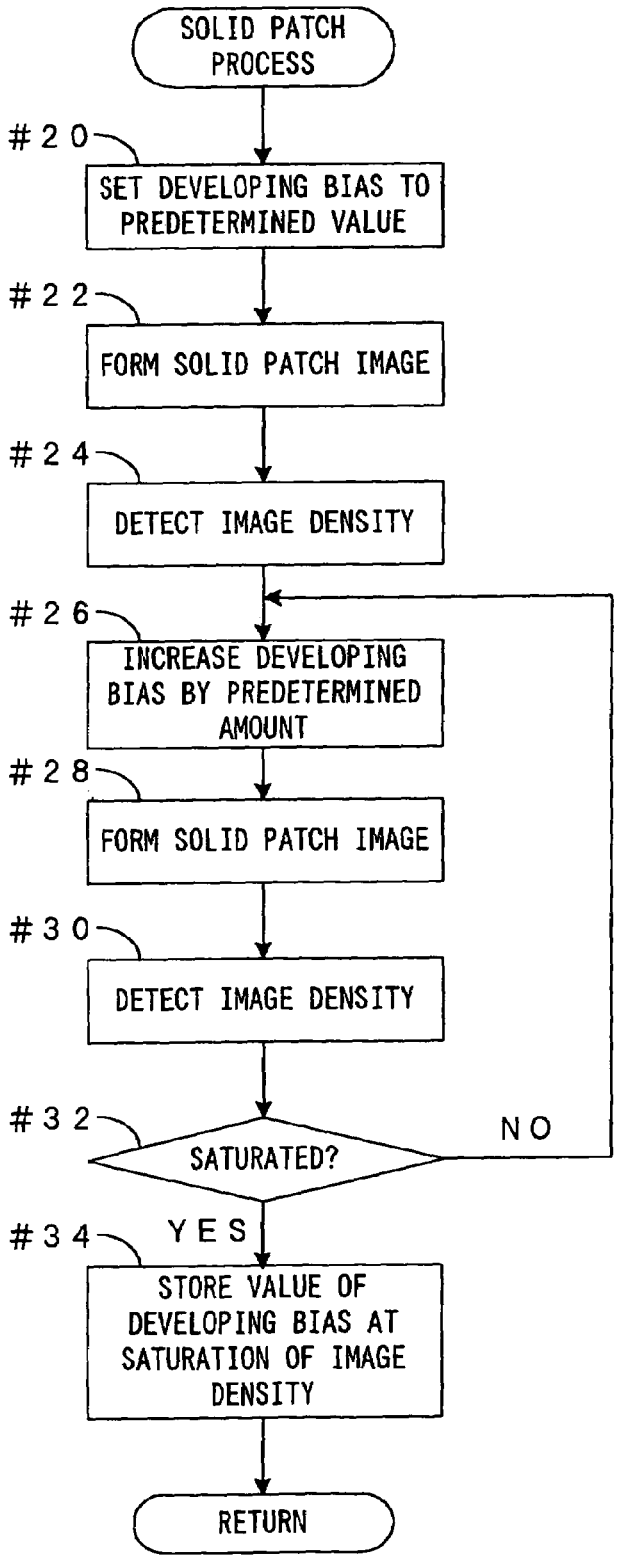
FIG. 10 is a flow chart representing the steps of a subroutine of a solid patch process shown in FIG. 9.
Figure 11:
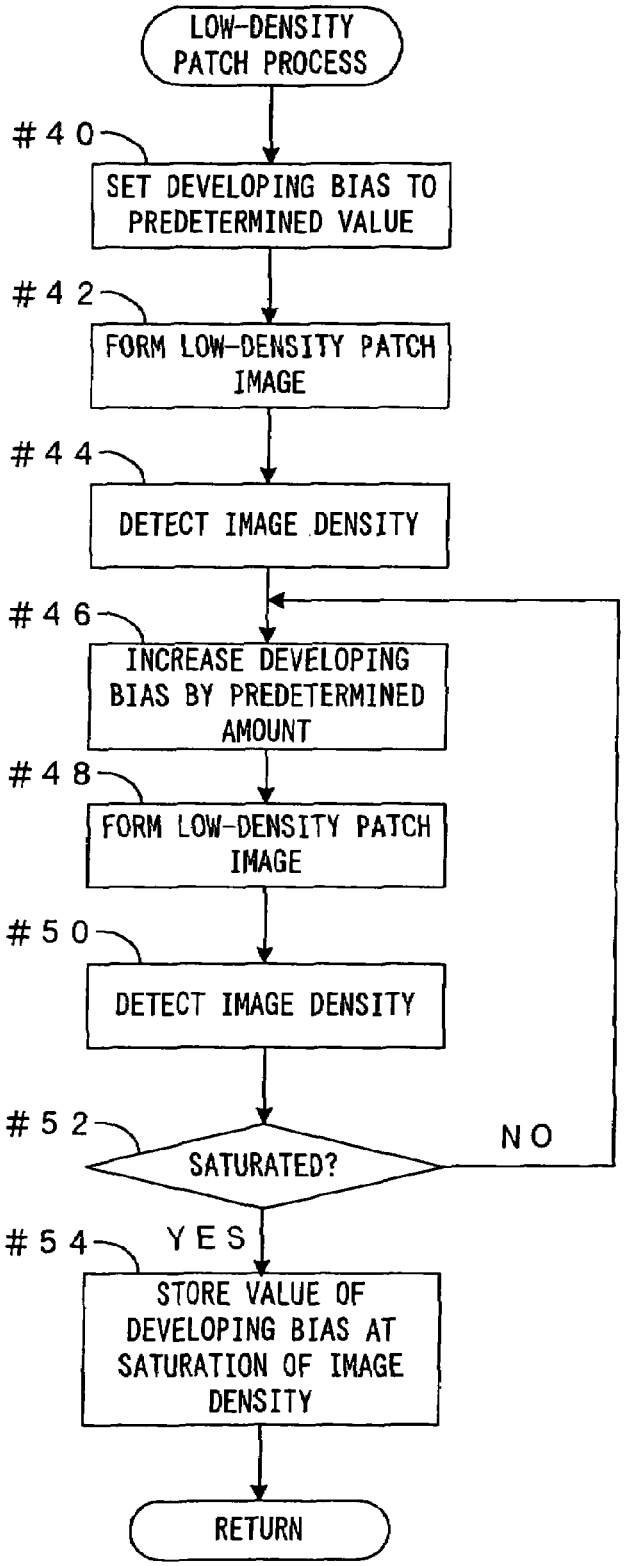
FIG. 11 is a flow chart representing the steps of a subroutine of a low-density patch process shown in FIG. 9.
Figure 12:
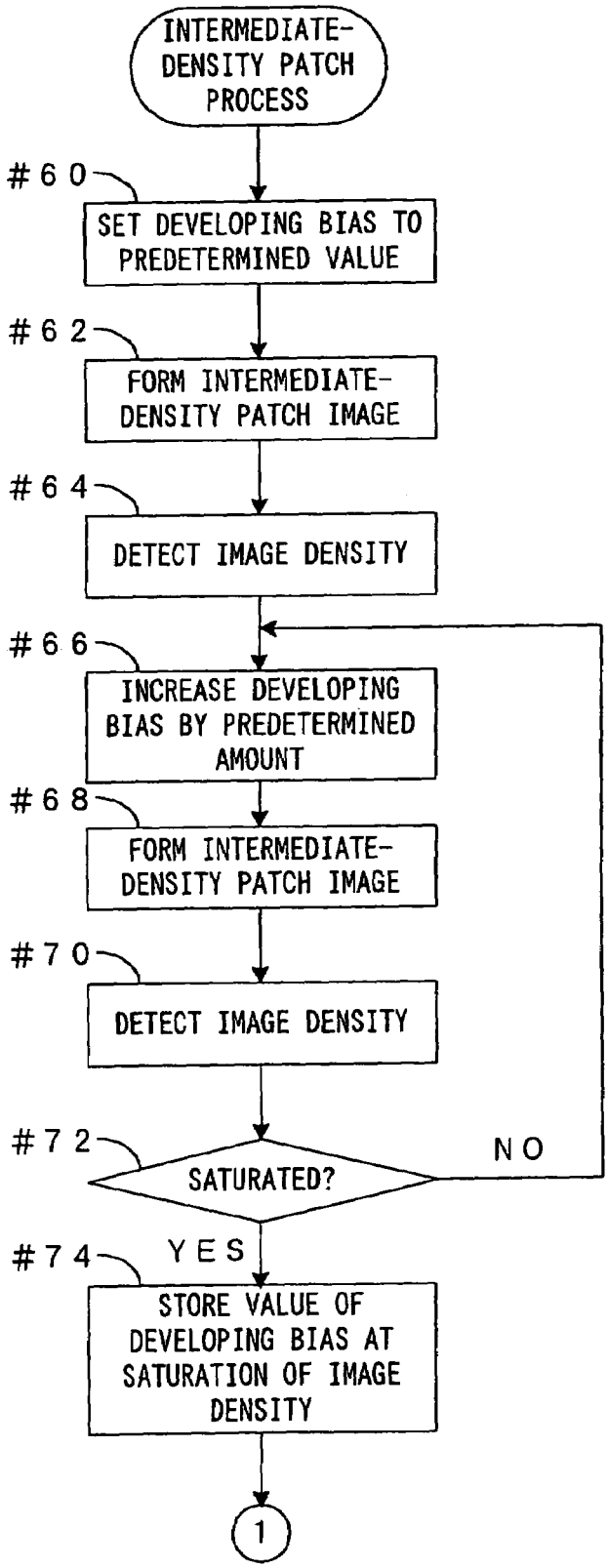
FIGS. 12 and 13 are flow charts representing the steps of a subroutine of an intermediate-density patch process shown in FIG. 9.
Figure 13:
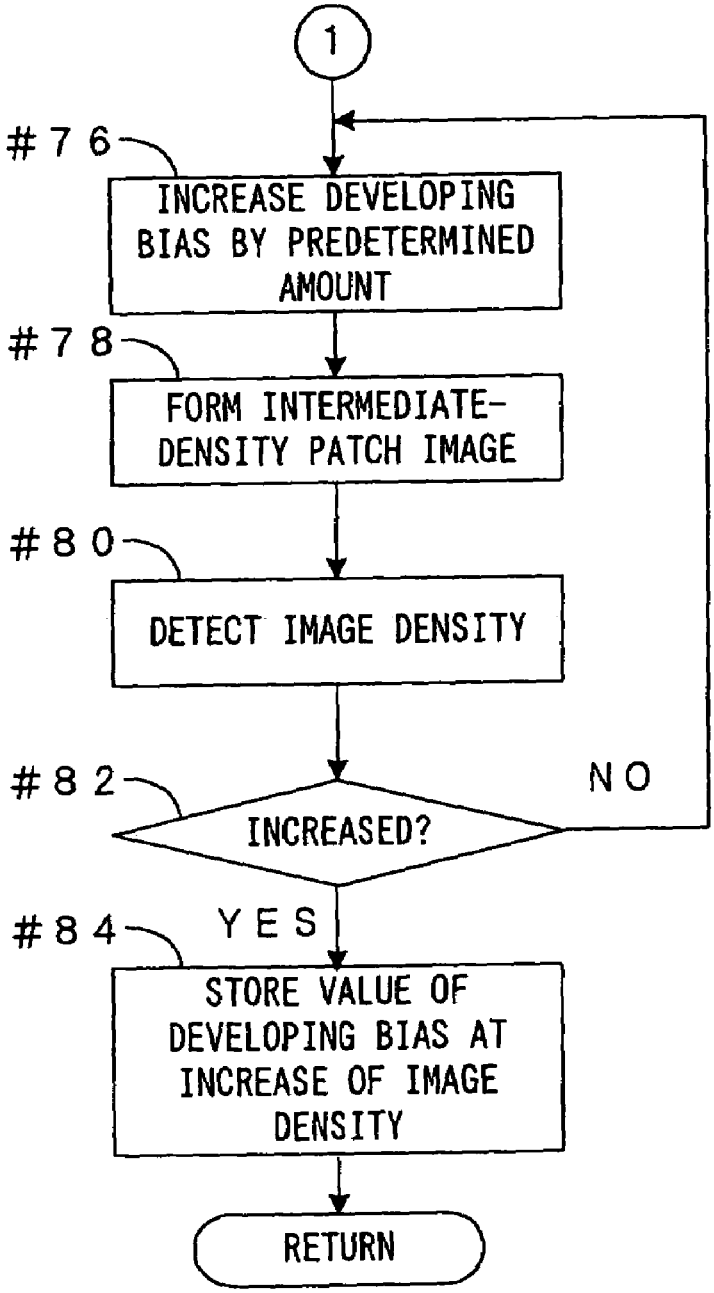

FIG. 9 is a flow chart representing the steps of an optimization process routine for image forming condition, whereas FIG. 10 is a flow chart representing the steps of a subroutine of a solid patch process shown in FIG. 9. FIG. 11 is a flow chart representing the steps of a subroutine of a low-density patch process shown in FIG. 9, whereas FIGS. 12 and 13 are flow charts representing the steps of a subroutine of an intermediate-density patch process shown in FIG. 9. The memory 116 of the engine controller 110 stores a control program of the optimization process for image forming condition. The CPU 113 controls the individual parts of the apparatus based on the control program so that the following optimization process is executed.

The optimization process for image forming condition first carries out a solid patch process (#10 in FIG. 9). In the solid patch process, as shown in FIG. 10, the developing bias Vb is set to a predetermined value (such as represented by V1 in FIG. 6) (#20), at which bias a solid patch image Q1 is formed (#22). It is noted that the other image forming conditions (the charging bias, exposure energy and the like) than the developing bias Vb are fixed. Therefore, the contrast potential Vcont can be set to any level by varying the developing bias Vb. A detection signal outputted from the patch sensor 17 is acquired in timed relation to the arrival of the solid patch image Q1 at a position facing the patch sensor 17, the patch image carried on the rotating photosensitive member 11. A density of the solid patch image Q1 is determined based on the signal and then stored in the memory 116 (#24).

Subsequently, the contrast potential Vcont is raised by increasing the developing bias Vb by a predetermined amount (#26). Then, a solid patch image Q1 is formed under the image forming condition thus set (#28). Then, in the same way as in the step #24 above, the density of the solid patch image Q1 is determined based on a detection signal outputted from the patch sensor 17 and is stored in the memory 116 (#30). The densities of the present solid patch image Q1 and of the preceding solid patch image Q1 are compared to determine whether the present image density is saturated or not based on, for example, whether an amount of density variation is within a predetermined range or not (#32). If the image density is saturated (YES at #32), the control flow proceeds to #34. If the image density is not saturated (NO at #32), the control flow returns to #26 to repeat the steps described above. Alternatively, it may be determined at #32 that the present image density is saturated if, for example, the amount of density variation is 1/10 or less of an initial amount of density variation (such as represented by an inclined line portion of the density curve of the solid image P1 shown in FIG. 6).

At step #34, a developing bias Vb (such as represented by V4 in FIG. 6) at the saturation of the image density is stored in the memory 116 and then, the control flow returns to the routine of FIG. 9 where the low-density patch process is performed (#12 in FIG. 9). In the low-density patch process, as shown in FIG. 11, the developing bias Vb is set to a predetermined value (such as represented by V2 in FIG. 6) (#40), at which bias a low-density patch image Q2 is formed (#42). Except for a step #48 for forming a low-density patch image Q2, operations at steps #44 through #52 are performed in the same procedure as the solid patch process of FIG. 10. Thus, the formation of the low-density patch image Q2 and the detection of the density thereof are repeated in cycles until the image density is saturated.

At step #54, a developing bias Vb (such as represented by V5 in FIG. 6) at the saturation of the image density is stored in the memory 116 and then, the control flow returns to the routine of FIG. 9 where the intermediate-density patch process is performed (#14 in FIG. 9). In the intermediate-density patch process, as shown in FIG. 12, the developing bias Vb is set to a predetermined value (such as represented by V1 in FIG. 6) (#60), at which bias an intermediate-density patch image Q3 is formed (#62). Except for a step #68 for forming an intermediate-density patch image Q3, operations at steps #64 through #72 are performed in the same procedure as the solid patch process of FIG. 10. Thus, the formation of the intermediate-density patch image Q3 and the detection of the density thereof are repeated in cycles until the image density is saturated.

At step #74, a developing bias Vb (such as represented by V4 in FIG. 6) at the saturation of the image density is stored in the memory 116. The subsequent steps #76 through #80 shown in FIG. 13 are performed the same way as at the steps #66 through #70 in FIG. 12. At step #82, the densities of the present intermediate-density patch image Q3 and of the preceding intermediate-density patch image Q3 are compared to determine whether the present image density is saturated or not based on, for example, whether an amount of density variation is within a predetermined range or not. If the image density does not start to increase (NO at #82), the control flow returns to #76 to repeat the procedure described above.

If the image density starts to increase again (YES at #82), a developing bias Vb at the increase of the image density (such as represented by V3 in FIG. 6) is stored in the memory 116 and then, the control flow returns to the routine of FIG. 9. Then, an optimum value of the developing bias Vb is determined and stored in the memory 116 (#16 in FIG. 9). According to the example shown in FIG. 6, for example, the optimum value of the developing bias Vb is set to a value satisfying V5<Vb<V3. The image forming condition thus determined may be written to the memory 38 of the development unit 30 (the memory incorporated in the development unit). At a proper time when, for example, the development unit 30 is mounted to the apparatus body 2, the image forming condition stored in the memory 38 may be written to the memory 116.

Figure 14:
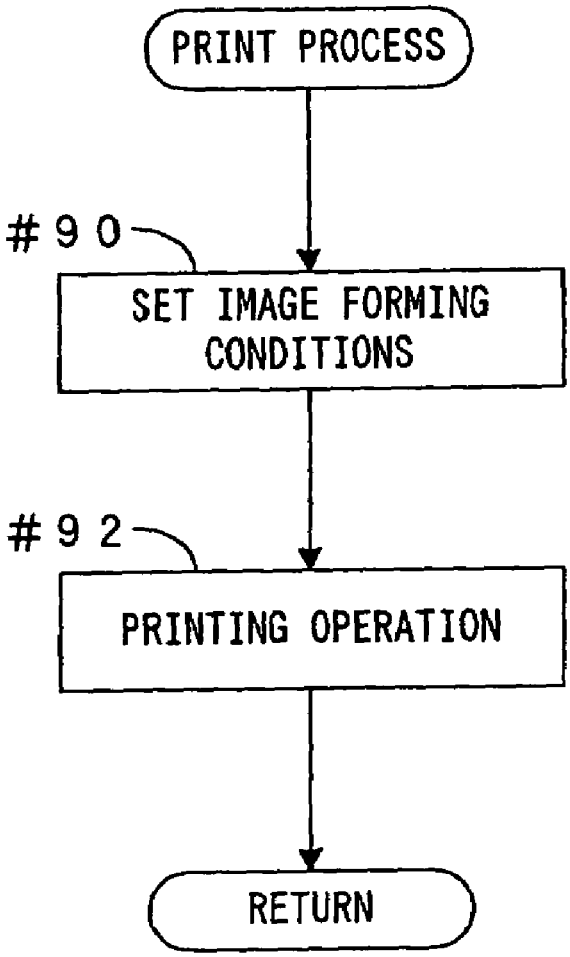
FIG. 14 is a flow chart representing the steps of a print process routine.

FIG. 14 is a flow chart representing the steps of a print process routine. When a print command signal from the external device is inputted via the main controller 100, the charging bias and the exposure energy are first set to the respective predetermined values as the image forming conditions while the developing bias Vb is set to the value determined by the optimization process for image forming condition (FIG. 9) and stored in the memory 116 (#90). Thereafter, a printing operation for forming a normal toner image is performed under the image forming conditions thus set (#92). Since the printing operation is carried out under the image forming condition determined by the optimization process, the solid image P1, the low-density image P2 and the intermediate-density image P3 may be formed in high quality.

As described above, according to the embodiment, a plurality of solid patch images Q1 are each formed with the contrast potential varied each time while the density of each patch image is detected by the patch sensor 17 so as to find the high-density image forming condition in which the adhesion amount of toner to the photosensitive member 11 is substantially saturated relative to the increase in the contrast potential. Then, a normal toner image is formed under the high-density image forming condition thus determined. Thus, the embodiment accomplishes the formation of the high-density image of good quality. Even in a case where the state of the apparatus is changed due to aging or the like, the embodiment always permits the above-mentioned high-density image forming condition to be determined.

Further, according to the embodiment, a plurality of low-density patch images Q2 are each formed with the contrast potential varied each time while the density of each patch image is detected by the patch sensor 17 so as to find the low-density image forming condition in which the adhesion amount of toner to the photosensitive member 11 is substantially saturated relative to the increase in the contrast potential. Then, a normal toner image is formed under the low-density image forming condition thus determined. Thus, the embodiment accomplishes the formation of the low-density image of good quality including the fine line or discrete dots. Even in a case where the state of the apparatus is changed due to aging or the like, the embodiment always permits the above-mentioned low-density image forming condition to be determined.

Further, according to the embodiment, a plurality of intermediate-density patch images Q3 are each formed with the contrast potential varied each time while the density of each patch image is detected by the patch sensor 17 so as to find the intermediate-density image forming condition in which the adhesion amount of toner to the photosensitive member 11 is substantially saturated relative to the increase in the contrast potential. Then, a normal toner image is formed under the intermediate-density image forming condition thus determined. Thus, the embodiment accomplishes the formation of the intermediate-density image of good quality including the hollow line or discrete hollow dots. Even in a case where the state of the apparatus is changed due to aging or the like, the embodiment always permits the above-mentioned intermediate-density image forming condition to be determined.

Modifications of the First Preferred Embodiment

It is to be noted that the present invention is not limited by the foregoing embodiment and various changes or modifications may be made thereto so long as such changes or modifications do not deviate from the scope of the present invention. For instance, the invention may adopt the following modifications.

(1) Although the embodiment uses the solid patch image Q1, the low-density patch image Q2 and the intermediate-density patch image Q3 as the patch image, the patch image is not limited to these. For instance, only the solid patch image Q1 may be used. This mode permits the above-mentioned high-density image forming condition to be determined. The toner image may be formed under the resultant high-density image forming condition thereby providing the high-density image of good quality.

Otherwise, only the low-density patch image Q2 may be used as the patch image. This mode permits the above-mentioned low-density image forming condition to be determined. The toner image may be formed under the resultant low-density image forming condition thereby providing the low-density image of good quality which includes the fine line or discrete dots.

Otherwise, only the intermediate-density patch image Q3 may be used as the patch image. This mode permits the above-mentioned intermediate-density image forming condition to be determined. The toner image may be formed under the resultant intermediate-density image forming condition thereby providing the intermediate-density image of good quality which includes the hollow line or discrete hollow dots.

In an alternative approach, for example, any 2 of the solid patch image Q1, the low-density patch image Q2 and the intermediate-density patch image Q3 may be used as the patch image. Particularly where the low-density patch image Q2 and the intermediate-density patch image Q3 are used to find an image forming condition satisfying both the low-density image forming condition and the intermediate-density image forming condition, the resultant image forming condition also satisfies the high-density image forming condition as shown in FIG. 6. Therefore, the formation of the high-density image of good quality is also expedited even though the solid patch image Q1 is not used.

(2) In the aforementioned first preferred embodiment, the patch images Q1, Q2, Q3 are formed to determine the respective image forming conditions. However, an alternative approach obviating the formation of the patch images, for example, may be taken. There may be previously determined a high-density image forming condition associated with the solid patch image P1, a low-density image forming condition associated with the low-density image P2, and an intermediate-density image forming condition associated with the intermediate-density image P3. The individual image forming conditions, an image forming condition satisfying any 2 of these, or an image forming condition satisfying all of these may be previously stored in the memory 116 or the memory 38 incorporated in the development unit, such that a normal toner image may be formed under the image forming condition stored in the memory 116, 38. This mode further expedites the formation of the respective images of good quality. According to this mode, the memories 116, 38 are equivalent to "storage means" of the present invention.

(3) In the first preferred embodiment described above, a reference image of a predetermined pattern (such as a solid image) may be formed for use in the adjustment of an electrical control condition for the charging bias applied by the charger 12, the developing bias applied to the developing roller 31, the primary transferring bias applied to the intermediate transfer roller 41, the secondary transferring bias applied to the secondary transfer roller 42, or the like. The density of the reference image may be detected by means of the patch sensor 17 so that the above-mentioned electrical control condition may be adjusted based on the detection result. According to this mode, the patch sensor 17 for detecting the densities of the patch images Q1 through Q3 also serves to detect the density of the reference image used for adjustment of the electrical control condition. Thus, the increase in the number of components is obviated. Furthermore, any one or all of the patch images Q1 through Q3 for use in the determination of the image forming conditions may also be used as the reference image. This contributes to an efficient patch process.

(4) The aforementioned first preferred embodiment adopts the method wherein the detection of the patch image density is performed with the developing bias Vb increased stepwise in order to find the image forming condition in which the adhesion amount of toner is saturated, but the invention is not limited to this. For instance, the maximum applicable value of the developing bias Vb is previously determined based on the characteristics of the apparatus, such as the development gap D or the like. Then, a plurality of patch images may be each formed with the developing bias Vb decreased from the maximum value by a predetermined amount each time.

Second Preferred Embodiment

By the way, the image forming apparatus of liquid development system involves the aforementioned problem that the variations of the toner density in the liquid developer results in the variations of the density of the toner image formed by developing the electrostatic latent image. In order to assure the formation of consistent images, therefore, the toner density in the liquid developer need be controlled. In this connection, there has been proposed an apparatus of an arrangement wherein a density of a patch image for use in the control of the toner density in the liquid developer is detected and then, the toner density in the liquid developer is adjusted based on the detection result (see, for example, Japanese Unexamined Patent Publication No. 9-114257 of 1997). The apparatus is designed to form the patch image for image density detection in a patch area defined outside an effective image region of the image carrier and to evaluate the toner density in the liquid developer based on the detected density of the patch image. The density of the patch image is defined to be higher than the maximum density of an effective image so that a lowered density of the patch image may be detected before the effective image suffers a lowered image density. Thus, the control of the toner density in the liquid developer is accomplished.

The density of the patch image is not merely varied by the variations of the toner density in the liquid developer but is affected by the image forming conditions including the developing bias, exposure energy, charging bias and the like, as conventionally well known in the art. This dictates the need for taking the image forming conditions into account in the determination of the toner density in the liquid developer based on the density of the patch image. Unfortunately, however, the image forming apparatus disclosed in the Japanese Unexamined Patent Publication No. 9-114257 does not give adequate consideration to the image forming conditions, thus coming short of ensuring that the toner density in the liquid developer is always determined with high accuracy.

Hence, a second preferred embodiment of the present invention is arranged to consider the image forming conditions including the developing bias, exposure energy, charging bias and the like, thereby accomplishing the high-accuracy determination of the toner density in the liquid developer. The second preferred embodiment is structured the same way as the printer of the first preferred embodiment described above with reference to FIGS. 1 and 2. According to the second preferred embodiment, the reservoir 33 is equivalent to a "vessel" of the present invention, whereas the operation display panel 7 is equivalent to "informing means" of the present invention. The following discussion focuses on difference from the first preferred embodiment.

The printer of the second preferred embodiment detects the toner density in the liquid developer in the following manner. This printer forms a patch image of a predetermined pattern (for example, a solid image according to the embodiment) at a proper time when the printer is turned on or when a predetermined number of prints have been produced. According to the embodiment, in particular, the toner density in the liquid developer is determined based on the density of a patch image formed under an image forming condition in which an adhesion amount of toner to the photosensitive material 11 is substantially saturated relative to the increase in the contrast potential. Based on the results, a density adjustment process is performed for adjusting the toner density in the reservoir 33. Now referring to FIG. 4 mentioned above, the following describes the reason for detecting the toner density based on the density of the patch image formed under the aforementioned image forming condition. Thereafter, operations of the embodiment will be described in details.

As described in the first preferred embodiment, the liquid developer 32 containing the toner in high density (e.g., from 5 to 40 wt %) is used so as to define the small development gap (e.g., from 5 to 40 μm). Accordingly, when the contrast potential is raised by increasing, for example, the developing bias, the magnitude of the resultant electric field is also increased correspondingly. This leads to a sharp increase of the amount of toner transferred from the developing roller 31 onto the photosensitive member 11 but the adhesion amount of toner becomes saturated at a given potential (represented by Vt in the figure) or above, as shown in FIG. 4A.

Since the adhesion amount of toner is saturated at the contrast potential in the range of Vt or above as seen in FIG. 4A, the density of a toner image formed at the contrast potential in this range is not dependent upon the contrast potential but is dependent solely upon the toner density in the liquid developer 32. Therefore, a toner image formed under an image forming condition included in this potential range may be used as the patch image such that the toner density in the liquid developer 32 may be accurately determined based on the density of the patch image. Likewise to the first preferred embodiment, "the adhesion amount of toner being substantially saturated" means that the increase of the contrast potential causes little increase in the amount of toner contributing to the development of the electrostatic latent image.

Figure 15:
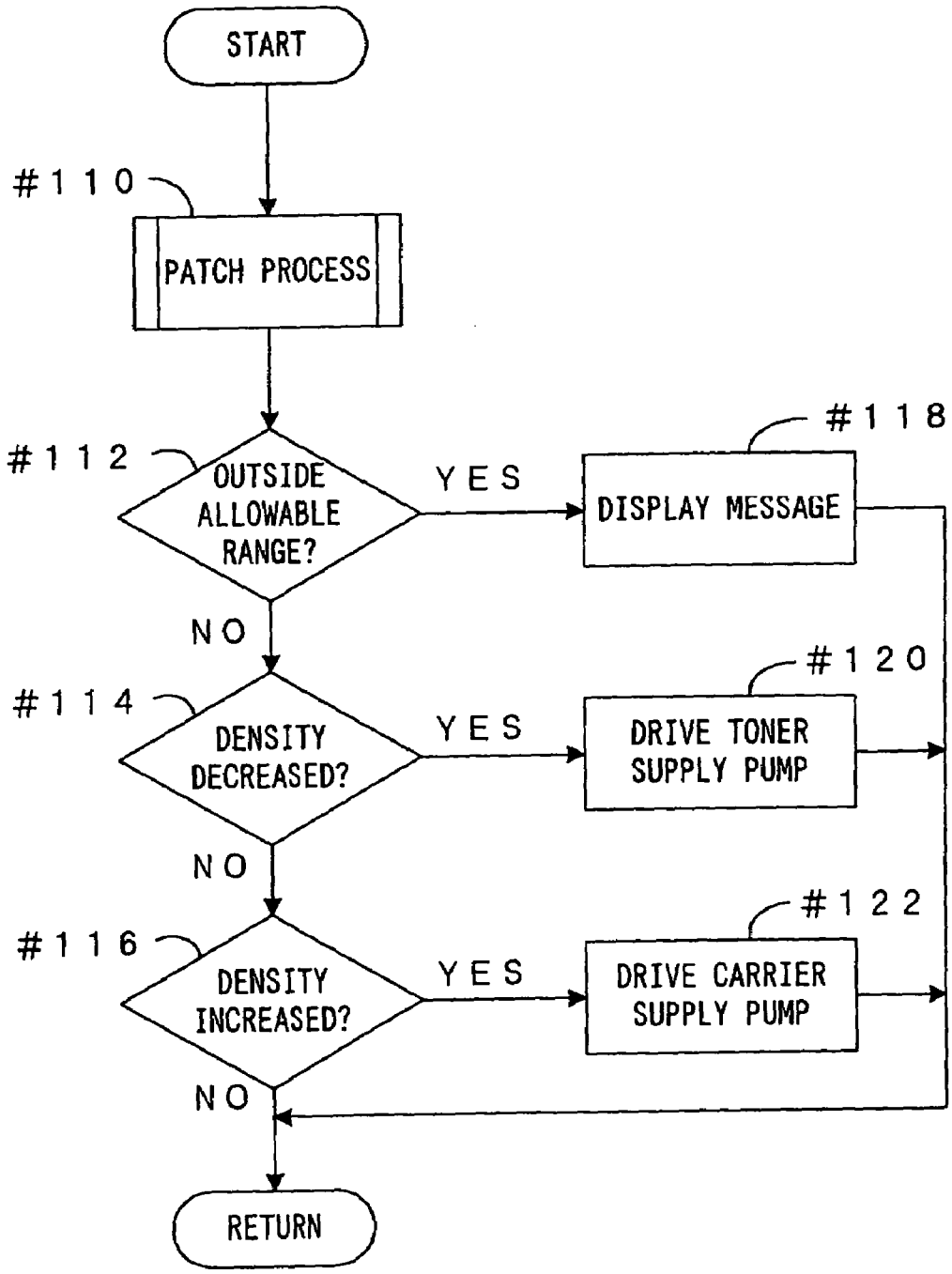
FIG. 15 is a flow chart representing the steps, of a density adjust process routine according to a second preferred embodiment hereof.
Figure 16:
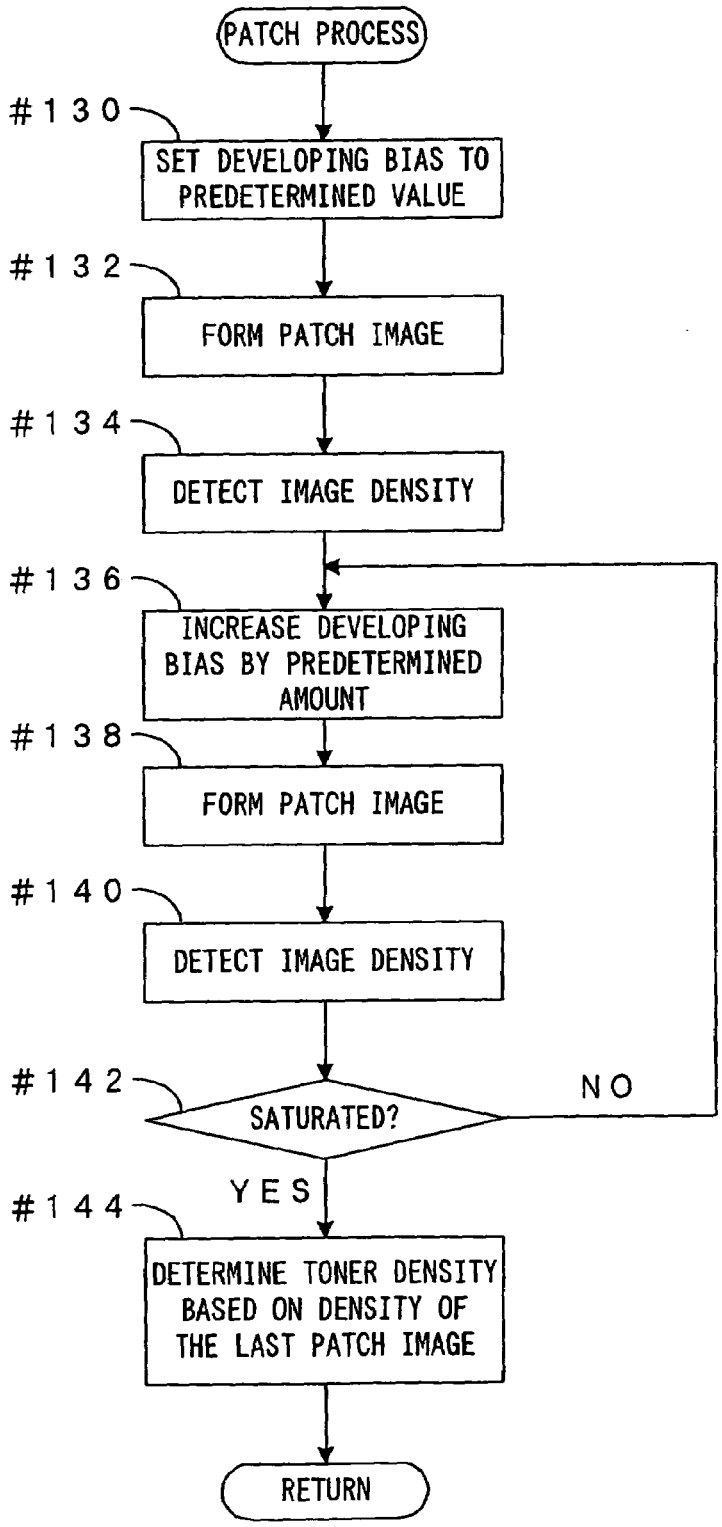
FIG. 16 is a flow chart representing the steps of a subroutine of a patch process shown in FIG. 15.
Figure 17:
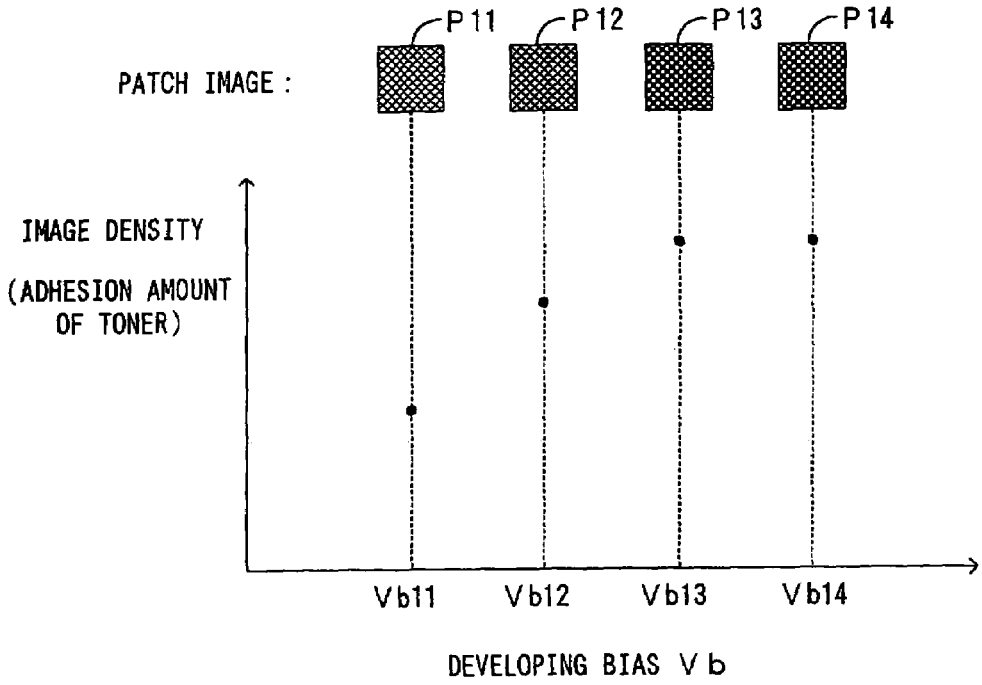
FIG. 17 is a graph illustrating density detection performed in the patch process of FIG. 16.

FIG. 15 is a flow chart representing the steps of a density adjustment process routine. FIG. 16 is a flow chart representing the steps of a subroutine of a patch process of FIG. 15. FIG. 17 is a graph illustrating density detection performed in the patch process of FIG. 16. A procedure of the density adjustment process will be described below according to the steps shown in FIGS. 15 and 16 and with reference to examples shown in FIG. 17. A control program for the density adjustment process is previously stored in the memory 116 of the engine controller 110. The CPU 113 controls the individual parts of the apparatus according to the control program whereby the following density adjustment process is carried out.

In the density adjustment process the patch process is first carried out (#110 in FIG. 15), where, as shown in FIG. 16, the developing bias Vb is set to a predetermined value (represented by Vb11 in FIG. 17) (#130), at which bias a patch image (represented by P11 in FIG. 17) is formed (#132). It is noted that the other image forming conditions (the charging bias, exposure energy and the like) than the developing bias Vb are fixed. Therefore, the contrast potential can be set to an arbitrary value by varying the developing bias Vb. A detection signal outputted from the patch sensor 17 is acquired in timed relation to the arrival of the patch image at a position facing the patch sensor 17, the patch image carried on the rotating photosensitive member 11. The density of the patch image P11 is determined based on the signal and then stored in the memory 116 (#134).

Subsequently, the contrast potential is raised by increasing the developing bias Vb by a predetermined amount (from Vb11 to Vb12 in FIG. 17) (#136). Then, a patch image (represented by P12 in FIG. 17) is formed under the image forming condition thus set (#138). Then, just as in the step #134 above, a density of the patch image is determined based on a detection signal outputted from the patch sensor 17 and is stored in the memory 116 (#140). The densities of the present patch image and of the preceding patch image (P12 and P11 in FIG. 17) are compared to determine whether the present image density is saturated or not based on, for example, whether an amount of density variation is within a predetermined range or not (#142). If the image density is saturated (YES at #142), the control flow proceeds to #144. If the image density is not saturated (NO at #142), the control flow returns to #136 to repeat the steps above.

According to an example shown in FIG. 17, the density of the patch image P12 is higher than that of the patch image P11 by more than the predetermined amount. Therefore, the contrast potential is raised by increasing the developing bias Vb from Vb12 to Vb13 whereas a patch image P13 is formed under an image forming condition thus set. A density of the patch image P13 is determined and stored in the memory 116 (#136 through #140). Thereafter, whether the density is saturated or not is determined (#142). According to FIG. 17, the density of the patch image P13 is higher than that of the patch image P12 by more than the predetermined amount and hence, the steps #136 through #142 are performed again. That is, the contrast potential is raised by increasing the developing bias Vb from Vb13 to Vb14 while a patch image P14 is formed under an image forming condition thus set. A density of the patch image P14 is determined and stored in the memory 116. Then, whether the density is saturated or not is determined. The density of the patch image P14 is substantially equal to that of the patch image P13 so that an amount of density variation is less than the predetermined amount. Thus, the step #142 gives YES and the control flow proceeds to #144. Alternatively, it may be determined at #142 that the image density is saturated if, for example, the amount of density variation is 1/10 or less of an initial amount of density variation (the difference between the densities of the patch images P11 and P12).

At step #144, the density of the patch image formed last (represented by P14 in FIG. 17) is used to determine a toner density in the liquid developer 32 and the control flow returns to the routine of FIG. 15. Determination is made as to whether the toner density thus determined is within an allowable range or not (#112). If the toner density does not fall outside the allowable range (NO at #112), then determination is made as to whether the toner density is decreased or not (#114). If the toner density is not decreased (NO at #114), then determination is made as to whether the toner density is increased or not (#116).

A relation between the density of the patch image formed under the image forming condition in which the adhesion amount of toner is saturated and the toner density in the liquid developer 32 is previously determined in the form of an operational expression or table data. The program stored in the memory 116 contains this relation, an initial value of the toner density in the liquid developer 32, and a lower limit and an upper limit of the allowable range thereof. The step #144 of determining the toner density shown in FIG. 16 is performed based on the above relation whereas the determination at #112 of FIG. 15 is made by comparing the toner density thus determined with the lower limit or the upper limit.

If the toner density falls outside the allowable range (YES at #112), a message indicating as such is displayed on the operation display panel 7 (#118) before this routine is terminated. When the toner density in the liquid developer falls outside the allowable range, the message indicating as such is given thereby urging the user to adjust the toner density in the liquid developer or to troubleshoot a problem of the apparatus. Thus, the apparatus is enhanced in the operability and serviceability.

Where the toner density thus determined is lower than the initial value (YES at #114), the toner supply pump 373 is driven by the pump driving section 118 for a length of time corresponding to a difference between the determined toner density and the initial value (#120), and then, the routine is terminated. Where, on the other hand, the toner density so determined is higher than the initial value (YES at #116), the carrier supply pump 374 is driven by the pump driving section 119 for a length of time corresponding to a difference between the toner density and the initial value (#122), and then, the routine is terminated. That is, the toner density in the liquid developer is adjusted to the initial value based on the density of the patch image.

In an alternative approach, the respective densities of the patch images corresponding to the initial value of the toner density in the liquid developer 32 and to the lower and upper limits of the allowable range thereof may be previously determined based on the relation between the density of the patch image formed under the image forming condition in which the adhesion amount of toner is saturated and the toner density in the liquid developer 32, and stored in the memory 116. A detected density of a patch image may be directly compared with a corresponding one of the stored values thereby making the determination at #112, #114 or #116 of FIG. 15.

As described above, according to the embodiment, the patch sensor 17 detects the density of the patch image formed under the image forming condition in which the adhesion amount of toner to the photosensitive member 11 is substantially saturated relative to the increase in the contrast potential, and then, the toner density in the liquid developer 32 is determined based on the detected image density. Therefore, the density of the patch image formed under the above-mentioned image forming condition is not susceptible to a certain degree of variations of the image forming conditions (such as the charging bias, the exposure energy and the developing bias) and is dependent solely upon the toner density in the liquid developer 32. Thus, the toner density can be determined with high accuracy.

Further, according to the embodiment, a plurality of patch images are each formed with the developing bias varied each time and the densities of the patch images are compared to determine whether the image density of interest is saturated or not. Therefore, even in a case where the image forming condition, in which the adhesion amount of toner to the photosensitive member 11 is substantially saturated, is varied due to the aging of the apparatus or the like, it is always ensured that the patch image for the image density detection is formed under the image forming condition in which the adhesion amount of toner is substantially saturated.

Furthermore, the toner density in the reservoir 33 is adjusted based on the density of the patch image and hence, the liquid developer adjusted for the toner density may always be used for the image formation. This ensures that the toner image of good quality is formed in a stable manner.

Modifications of the Second Preferred Embodiment

It is to be noted that the present invention is not limited by the foregoing embodiment and various changes or modifications may be made thereto so long as such changes or modifications do not deviate from the scope of the present invention. For instance, the invention may adopt the following modifications.

(1) In the second preferred embodiment described above, the toner density in the liquid developer 32 is determined based on the density of the last patch image (represented by the patch image P14 in FIG. 17) associated with the density-saturated patch image but the invention is not limited to this. For instance, a mean value of the densities of the two patch images (the patch images P13 and P14 in FIG. 17) which are determined to be saturated may be used for determining the toner density in the liquid developer 32. This mode reduces the measurement variations so that the toner density may be determined with higher accuracy.

(2) The second preferred embodiment obtains the density of the patch image formed under the image forming condition in which the adhesion amount of toner is saturated while increasing the developing bias stepwise, but the invention is not limited to this. For instance, the maximum applicable value of the developing bias may be previously determined based on the characteristics, such as the development gap, of the apparatus and the developing bias may be decreased from the maximum value in steps by a predetermined amount. In this case, the formation of the patch images may be stopped at the time when the density of the patch image is determined to be saturated (when the patch image P13 is formed following the formation of the patch image P14 according to FIG. 17, for example). This results in a faster determination of the density of the patch image formed under the image forming condition in which the adhesion amount of toner is saturated.

(3) An alternative approach may be taken wherein a developing bias assuredly achieving the saturated image density (such as the maximum applicable value of the developing bias determined based on the characteristics of the apparatus) is previously determined and stored in the memory 116 or 38 and wherein the patch image is formed at this developing bias. According to this mode, only one patch image need be formed so that the toner density may be determined in a more simple manner. In this mode, the memory 116 or the memory 38 is equivalent to the "storage means" of the present invention.

Common Modification to the First and Second Preferred Embodiments (4) While the first and second preferred embodiments vary the contrast potential Vcont by varying the developing bias Vb, the invention is not limited to this. The contrast potential Vcont may be varied by varying a latent-image forming condition such as the charging bias Vd or the exposure energy. In this case, the charging bias generating section 111 may be so controlled as to vary the charging potential Vd applied to the photosensitive member 11 by the charger 12, or the exposure control section 112 may be so controlled as to vary the amount of the light beam 21 emitted from the exposure unit 20.

Third Preferred Embodiment

Similarly to the second preferred embodiment, a third preferred embodiment of the present invention is directed to high accuracy determination of the toner density in the liquid developer by giving consideration to the image forming conditions such as the developing bias, exposure energy and charging bias. The third preferred embodiment is structured the same way as the printer of the first preferred embodiment described above with reference to FIGS. 1 and 2. According to the third preferred embodiment, the reservoir 33 is equivalent to the "vessel" of the present invention, whereas the operation display panel 7 is equivalent to the "informing means" of the present invention. The following discussion focuses on difference from the first preferred embodiment.

A printer of the third preferred embodiment detects the toner density in the liquid developer in the following manner. Specifically, likewise to the second preferred embodiment, the printer forms a patch image of a predetermined pattern (for example, a solid image according to the embodiment) at a proper time when the printer is turned on or when a predetermined number of prints have been produced. According to the embodiment, in particular, the toner density in the liquid developer is determined based on the density of the patch image formed under an image forming condition in which not less than 90% of the toner present in the liquid developer at the development position 16 adhere to the photosensitive member 11. Then, a density adjustment process is performed for adjusting the toner density in the reservoir 33 based on the determined toner density. Now referring to FIGS. 3, 18A and 18B, the reason for detecting the toner density based on the density of the patch image formed under the aforementioned image forming condition is described. Thereafter, operations of the embodiment will be described in details.

Figure 18A:
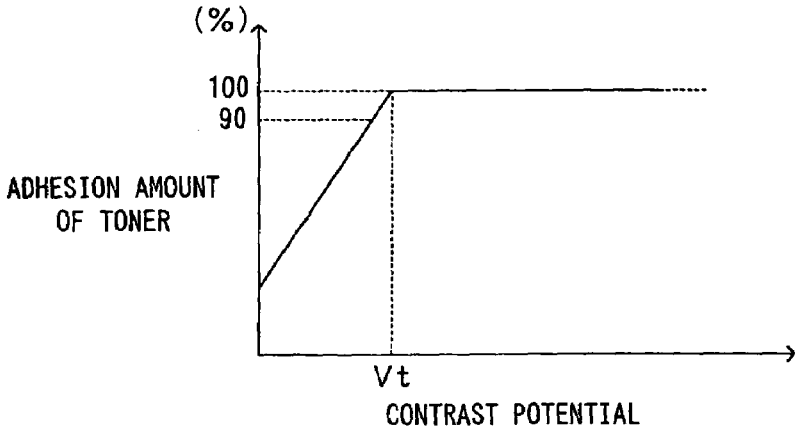
FIGS. 18A and 18B are graphs each illustrating the adhesion amount of toner according to a third preferred embodiment hereof.
Figure 18B:
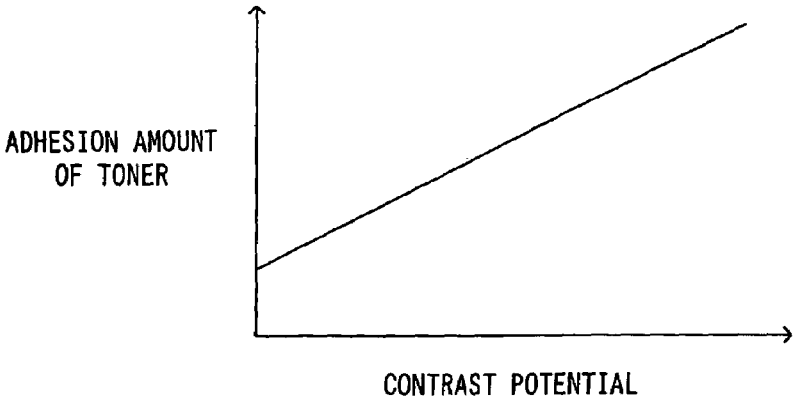

FIGS. 18A and 18B are graphs each illustrating the adhesion amount of toner. As described in the first preferred embodiment, the liquid developer 32 having a high density of the toner (e.g., from 5 to 40 wt %) is used for defining the small development gap (e.g., from 5 to 40 μm). Therefore, when the contrast potential is raised by increasing the developing bias, for example, the magnitude of the resultant electric field is also increased correspondingly. Hence, as shown in FIG. 18A, the amount of toner transferred from the developing roller 31 onto the photosensitive member 11 is rapidly increased and becomes saturated at a certain potential (represented by Vt in the figure) or above.

It is noted here that a state where the adhesion amount of toner is in saturation at the contrast potential in the range of Vt or above as shown in FIG. 18A is considered that all the toner present in the liquid developer transported to the development position 16 by means of the developing roller 31 is made to adhere to the photosensitive member 11. Accordingly, the density of the patch image formed under a condition causing the most of the toner (e.g., 90% or more according to the embodiment) present in the liquid developer at the development position 16 may be said to reflect the toner density in the liquid developer substantially accurately.

Therefore, in the embodiment, such an image forming condition (such as the charging bias, exposure energy or developing bias) in which, for example, not less than 90% of the toner present in the liquid developer at the development position 16 adhere to the photosensitive member 11 is previously determined and is stored as a control program in the memory 116. Then, a patch image is formed under the image forming condition stored in the memory 116, and the toner density in the liquid developer 32 is determined based on the density of the patch image. Thus, according to the embodiment, the memory 116 is equivalent to the "storage means" of the present invention.

On the other hand, in a case where the low-density liquid developer (e.g., from 1 to 2 wt % of toner) is used, the large development gap (e.g., from 100 to 200 μm) must be defined to ensure an adequate amount of toner. Hence, increasing the contrast potential merely causes a slow increase of the electric field so that the amount of toner transferred from the developing roller 31 onto the photosensitive member 11 continues to rise slowly but is never saturated, as shown in FIG. 18B which shows a reference example. This makes it impossible to define the image forming condition in which the most of the toner present in the liquid developer at the development position 16 adhere to the photosensitive member 11.

It is noted here that a ratio of the toner adhered to the photosensitive member 11 versus the toner present in the liquid developer at the development position 16 will be hereinafter referred to as "toner adhesion percentage". As shown in FIG. 3, the liquid developer 32 containing the toner 322 dispersed in the carrier liquid 321 is transported to the development position 16 while being carried on the surface of the developing roller 31 so that the toner is made to adhere to the photosensitive member 11. As described in the first preferred embodiment, the gap D between the photosensitive member 11 and the developing roller 31, or the thickness of liquid developer layer is so regulated to maintain a predetermined value (e.g., 7 μm according to the embodiment). On the other hand, the development nip length L is defined by a circumferential length on which the liquid developer contacts both the photosensitive member 11 and the developing roller 31. The development nip is defined to be 5 mm according to the embodiment.

The "toner adhesion percentage" in this case is proportional to the product of the electric field E generated at the development position 16 and the development time T. The electric field E is expressed as follows:

$$E=\epsilon 1(Vs-Vd)/(L2\cdot\epsilon 1+L1\cdot\epsilon 2),$$

where $\epsilon 1$ denotes a relative dielectric constant of a photosensitive layer of the photosensitive member 11;

Vs denotes a charging bias applied to the photosensitive member 11;

Vd denotes a developing bias;

L1 denotes a thickness of a photosensitive layer of the photosensitive member 11;

L2 denotes a thickness of liquid developer layer on the photosensitive member 11; and $\epsilon 2$ denotes a relative dielectric constant of liquid developer layer.

The development time T is expressed as:

$$T=L/S,$$

where S denotes a circumferential speed of the photosensitive member 11.

In the embodiment, an image forming condition (such as the charging bias, exposure energy or developing bias) in which the "toner adhesion percentage" is not less than 90% is previously determined based on the above-mentioned expressions and the image forming condition thus determined is stored in the memory 116 as the control program.

Figure 19:
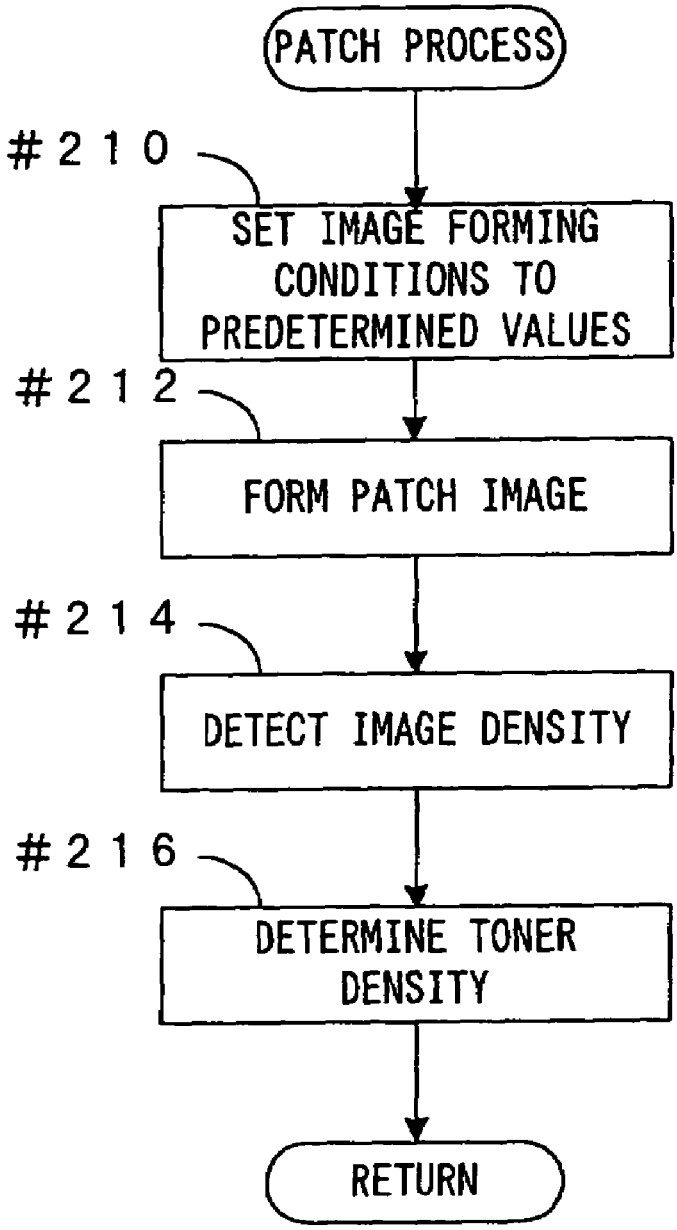
FIG. 19 is a flow chart representing the steps of a subroutine of a patch process according to the third preferred embodiment.

Next, a procedure of the density adjustment process is described. FIG. 19 is a flow chart representing the steps of a subroutine of a patch process according to the third preferred embodiment. A routine of the density adjustment process of the third preferred embodiment is the same as that of the second preferred embodiment described above with reference to FIG. 15, except for the subroutine of the patch process. A control program for the density adjustment process is previously stored in the memory 116 of the engine controller 110. The CPU 113 controls the individual parts of the apparatus based on the control program whereby the density adjustment process is carried out.

In the patch process of the third preferred embodiment, as shown in FIG. 19, the image forming conditions including the charging bias, developing bias, exposure energy and the like are set to respective predetermined values (#210), then a patch image is formed under the conditions (#212). A detection signal outputted from the patch sensor 17 is acquired in timed relation to the arrival of the patch image at the position facing the patch sensor 17, the patch image carried on the rotating photosensitive member 11. A density of the patch image is determined based on the signal (#214).

Then, the density of the patch image is used to determine a toner density in the liquid developer 32 (#216), and the control flow returns to the routine of FIG. 15.

A relation between the density of the patch image formed under the image forming condition in which the "toner adhesion percentage" is not less than 90% and the toner density in the liquid developer 32 is previously determined in the form of an operational expression or table data. The program stored in the memory 116 contains this relation, an initial value of the toner density in the liquid developer 32, and an upper limit and a lower limit of an allowable range thereof. The step #216 in FIG. 19 is performed for determining a toner density based on the above-mentioned relation. The resultant toner density is compared with the lower limit or the upper limit thereby to make the evaluation at #112 in FIG. 15.

In an alternative approach, respective densities of patch images corresponding to the initial value of the toner density in the liquid developer 32, the lower and upper limits of the allowable range thereof may be previously determined based on the relation between the patch image formed under the image forming condition in which the "toner adhesion percentage" is not less than 90% and the toner density in the liquid developer 32 and then, stored in the memory 116. A detected density of the patch image may be directly compared with a corresponding one of these density values so as to make the evaluation at the respective steps #112, #114 and #116 in FIG. 15.

As described above, according to the embodiment, the image forming condition in which the most (not less than 90% according to the embodiment) of the toner present in the liquid developer at the development position 16 adhere to the photosensitive member 11 is previously stored in the memory 116; the density of a patch image formed under the image forming condition is detected by means of the patch sensor 17; and then the toner density in the liquid developer 32 is determined based on the detected image density. Accordingly, the density of the patch image formed under the above-mentioned image forming condition substantially accurately reflects the toner density in the liquid developer 32 and hence, high accuracy determination of the toner density may be accomplished.

Further, according to the embodiment, the toner density in the reservoir 33 is adjusted based on the density of the patch image and hence, the liquid developer adjusted for the toner density may always be used for the image formation. This ensures that the toner image of good quality is formed in a stable manner.

Modifications Common to the Second and Third Preferred Embodiments

It is to be noted that the present invention is not limited by the foregoing embodiments and various changes or modifications may be made thereto so long as such changes or modifications do not deviate from the scope of the present invention. For instance, the invention may adopt the following modifications.

(1) The second and third preferred embodiments described above are structured to lower the toner density in the liquid developer 32 by supplying the reservoir 33 with the carrier liquid from the supply tank 372, but the invention is not limited to this. For instance, there may be provided a mechanism which recovers the carrier liquid cleaned off from the photosensitive member 11 or the intermediate transfer roller 41 so as to return the resultant carrier liquid to the reservoir 33 and which may be operated at determination of an increased toner density (YES at #116 in FIG. 15), thereby lowering the toner density in the liquid developer 32 in the reservoir 33.

(2) The second and third preferred embodiments described above are structured to increase the toner density in the liquid developer 32 by supplying the reservoir 33 with the higher-density liquid developer from the supply tank 371, but the invention is not limited to this. For instance, the toner density in the liquid developer 32 may be increased by consuming the carrier liquid by performing a developing operation in a manner to develop a white solid image or to increase an interval between developing processes in the normal image forming operations.

(3) The second and third preferred embodiments described above are provided with the toner density adjusting section 37 for adjusting the toner density in the liquid developer 32 in the reservoir 33. An alternative arrangement may be made such that the toner density adjusting section 37 is obviated and that the image forming condition for forming a normal toner image is adjusted when a decreased toner density (YES at #114 in FIG. 15) or an increased toner density (YES at #116 in FIG. 15) is detected. It is noted here that the image forming condition includes the charging bias generated by the charging bias generating section 111, the exposure energy of the light beam 21 controlled by the exposure control section 112, the developing bias generated by the developing bias generating section 114, the primary transferring bias and the secondary transferring bias generated by the transferring bias generating section 115 and the like.

Modifications Common to the First through Third Preferred Embodiments (4) The first through third preferred embodiments described above are structured to detect the density of the patch image formed on the photosensitive member 11 but the position of the density detection is not limited to this. For instance, an arrangement may be made wherein the density of the patch image primarily transferred from the photosensitive member 11 to the intermediate transfer roller 41 is detected. In this case, the patch sensor 17 may be disposed at a place around the intermediate transfer roller 41 and between the primary transfer position 44 and the secondary transfer position 45. According to this mode, the intermediate transfer roller 41 is equivalent to a "transfer medium" of the present invention, whereas the transferring bias generating section 115 is equivalent to "transferring means" of the present invention. Otherwise, an arrangement may be made such that the patch image is transferred to the transfer sheet 4 and the density of the resultant patch image is detected.

An alternative arrangement may be made wherein a special member for transferring the patch image (such as a patch transferring roller), for example, is abutted against the photosensitive member 11 or the intermediate transfer roller 41 and is applied with a transferring bias so as to detect the density of a patch image transferred to the special member. In this case, the patch sensor may be disposed to face the special member. According to this mode, the above-mentioned special member is equivalent to the "transfer medium" of the present invention, whereas means for applying the transferring bias to the special member is equivalent to the "transferring means" of the present invention.

(5) The first through third preferred embodiments described above are described by way of the example of the printer designed to print the image on the transfer sheet, the image supplied from the external device such as the host computer. However, the invention is not limited to this and is applicable to the general electrophotographic image forming apparatuses including the copiers, facsimile machines and the like. Although the foregoing embodiments apply the invention to the monochromatic image forming apparatuses, the application of the present invention is not limited to this. The invention is also applicable to color image forming apparatuses. In this case, or particularly in the second and third preferred embodiments, the toner density in the liquid developer may be detected and adjusted on a per-color basis.

Although the invention has been described with reference to specific embodiments, this description is not meant to be construed in a limiting sense. Various modifications of the disclosed embodiments, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

an image carrier structured to carry an electrostatic latent image on its surface;

a liquid developer carrier which transports liquid developer toward a development position facing the image carrier while carrying the liquid developer on its surface, the liquid developer with toner dispersed in a carrier liquid; and an image forming unit which applies a developing bias to the liquid developer carrier for causing the toner in the liquid developer on the liquid developer carrier to adhere to the image carrier, thereby developing the electrostatic latent image with the toner to form a toner image; and a density detector which detects a density of the toner image formed by the image forming unit, wherein the image forming unit forms a patch image as the toner image under an image forming condition in which an adhesion amount of toner to the image carrier is substantially saturated relative to an increase of contrast potential, and wherein a toner density in the liquid developer is determined based on the density of the patch image detected by the density detector.

2. An image forming apparatus according to claim 1, wherein the toner density in the liquid developer is adjusted based on the density of the patch image.

3. An image forming apparatus according to claim 2, further comprising a vessel for storing the liquid developer, wherein the toner density in the liquid developer stored in the vessel is adjusted based on the density of the patch image, and wherein the liquid developer carrier transports the liquid developer thus adjusted toward the development position.

4. An image forming apparatus according to claim 1, wherein an image forming condition for forming a normal toner image is adjusted based on the density of the patch image.

5. An image forming apparatus according to claim 1, further comprising an informing unit which gives a message when the toner density in the liquid developer is determined to fall outside a predetermined range, the message indicating the toner density being deviated from the range.

6. An image forming apparatus according to claim 1, wherein the density detector detects a density of the patch image formed on the image carrier.

7. An image forming apparatus according to claim 1, further comprising a transferring unit which transfers the toner image formed on the image carrier onto a transfer medium, wherein the density detector detects a density of the patch image transferred from the image carrier to the transfer medium.

8. An image forming apparatus according to claim 1, wherein the image forming unit forms a plurality of patch images as the toner images at varied contrast potentials, and wherein the image forming condition in which an adhesion amount of toner to the image carrier is substantially saturated relative to the increase in contrast potential is determined based on the densities of the plurality of patch images detected by the density detector.

9. An image forming apparatus according to claim 1, further comprising a storage unit which stores the image forming condition in which an adhesion amount of toner to the image carrier being substantially saturated relative to the increase in contrast potential, wherein the image forming unit forms the patch image under the image forming condition stored in the storage unit.

10. An image forming method, wherein a developing bias is applied to a liquid developer carrier carrying thereon liquid developer with charged toner dispersed in a carrier liquid, thereby causing the toner in the liquid developer on the liquid developer carrier to adhere to an image carrier, whereby an electrostatic latent image on the image carrier is developed with the toner to form a toner image, the method further comprising:

forming a patch image as the toner image under an image forming condition in which an adhesion amount of toner to the image carrier is substantially saturated relative to an increase in contrast potential;

detecting a density of the patch image; and determining a toner density in the liquid developer based on a detected density of the patch image.

11. An image forming apparatus comprising:

an image carrier structured to carry an electrostatic latent image on its surface;

a liquid developer carrier which transports liquid developer toward a development position facing the image carrier while carrying the liquid developer on its surface the liquid developer with toner dispersed in a carrier liquid;

an image forming unit which applies a developing bias to the liquid developer carrier for causing the toner in the liquid developer on the liquid developer carrier to adhere to the image carrier, thereby developing the electrostatic latent image with the toner to form a toner image; and a density detector which detects a density of the toner image formed by the image forming unit, wherein the image forming unit forms a patch image as the toner image under an image forming condition in which not less than 90% of the toner in the liquid developer at the development position is adhered to the image carrier, and wherein a toner density in the liquid developer is determined based on the density of the patch image detected by the density detector.

12. An image forming apparatus according to claim 11, wherein the toner density in the liquid developer is adjusted based on the density of the patch image.

13. An image forming apparatus according to claim 12, further comprising a vessel for storing the liquid developer, wherein the toner density in the liquid developer stored in the vessel is adjusted based on the density of the patch image, and wherein the liquid developer carrier transports the liquid developer thus adjusted toward the development position.

14. An image forming apparatus according to claim 11, wherein an image forming condition for forming a normal toner image is adjusted based on the density of the patch image.

15. An image forming apparatus according to claim 11, further comprising an informing unit which gives a message when the toner density in the liquid developer is determined to fall outside a predetermined range, the message indicating the toner density being deviated from the range.

16. An image forming apparatus according to claim 11, wherein the density detector detects a density of the patch image formed on the image carrier.

17. An image forming apparatus according to claim 11, further comprising a transferring unit which transfers the toner image formed on the image carrier onto a transfer medium, wherein the density detector detects a density of the patch image transferred from the image carrier to the transfer medium.

18. An image forming apparatus according to claim 11, further comprising a storage unit which stores the image forming condition in which not less than 90% of the toner in the liquid developer at the development position is adhered to the image carrier, wherein the image forming unit forms the patch image under the image forming condition stored in the storage unit.

19. An image forming method, wherein a developing bias is applied to a liquid developer carrier which transports liquid developer with charged toner dispersed in a carrier liquid toward a development position facing an image carrier, thereby causing the toner in the liquid developer on the liquid developer carrier to adhere to the image carrier, whereby an electrostatic latent image on the image carrier is developed with the toner to form a toner image, the method further comprising:

forming a patch image as the toner image under an image forming condition in which not less than 90% of the toner in the liquid developer at the development position is adhered to the image carrier;

detecting a density of the patch image; and determining a toner density in the liquid developer based on a detected density of the patch image.

* * * * *